US010887720B2

(12) United States Patent
Dicker

(10) Patent No.: US 10,887,720 B2
(45) Date of Patent: Jan. 5, 2021

(54) EMPHASIS FOR AUDIO SPATIALIZATION

(71) Applicant: Magic Leap, Inc., Plantation, FL (US)

(72) Inventor: Samuel Charles Dicker, San Francisco, CA (US)

(73) Assignee: Magic Leap, Inc., Plantation, FL (US)

( * ) Notice: Subject to any disclaimer, the term of this patent is extended or adjusted under 35 U.S.C. 154(b) by 0 days.

(21) Appl. No.: 16/593,944

(22) Filed: Oct. 4, 2019

(65) Prior Publication Data

US 2020/0112816 A1 Apr. 9, 2020

Related U.S. Application Data

(60) Provisional application No. 62/742,191, filed on Oct. 5, 2018, provisional application No. 62/742,254, filed (Continued)

(51) Int. Cl.
*H04S 7/00* (2006.01)
*H04R 5/033* (2006.01)

(Continued)

(52) U.S. Cl.
CPC ..... *H04S 7/304* (2013.01); *H04R 3/04* (2013.01); *H04R 5/033* (2013.01); *H04R 5/04* (2013.01);

(Continued)

(58) Field of Classification Search
CPC . H04S 7/304; H04S 7/30; H04S 7/302; H04S 3/008; H04S 2420/01;

(Continued)

(56) References Cited

U.S. PATENT DOCUMENTS 5,491,839 A * 2/1996 Schotz ..... H04B 1/04 381/79
8,428,269 B1 * 4/2013 Brungart ..... H04S 7/304 381/17
2003/0007648 A1 * 1/2003 Currell ..... H04S 7/305 381/61

FOREIGN PATENT DOCUMENTS

EP 0138548 A2 * 4/1985 ..... H03M 3/022
EP 0138548 A2 4/1985

OTHER PUBLICATIONS

International Search Report and Written Opinion dated Dec. 20, 2019, for PCT Application No. PCT/US2019/54894, filed Oct. 4, 2019, fourteen pages.

(Continued)

*Primary Examiner* — Yogeshkumar Patel
(74) *Attorney, Agent, or Firm* — Morrison & Foerster LLP

(57) ABSTRACT

Examples of the disclosure describe systems and methods for presenting an audio signal to a user of a wearable head device. According to an example method, a first input audio signal is received. The first input audio signal is processed to generate a first output audio signal. The first output audio signal is presented via one or more speakers associated with the wearable head device. Processing the first input audio signal comprises applying a pre-emphasis filter to the first input audio signal; adjusting a gain of the first input audio signal; and applying a de-emphasis filter to the first audio signal. Applying the pre-emphasis filter to the first input audio signal comprises attenuating a low frequency component of the first input audio signal. Applying the de-emphasis filter to the first input audio signal comprises attenuating a high frequency component of the first input audio signal.

57 Claims, 17 Drawing Sheets

Related U.S. Application Data on Oct. 5, 2018, provisional application No. 62/812,546, filed on Mar. 1, 2019.

(51) Int. Cl.
*H04R 5/04* (2006.01)
*H04S 3/00* (2006.01)
*H04R 3/04* (2006.01)

(52) U.S. Cl.
CPC ..... *H04S 3/008* (2013.01); *H04S 7/307* (2013.01); *H04S 2400/01* (2013.01); *H04S 2400/11* (2013.01); *H04S 2400/13* (2013.01); *H04S 2420/01* (2013.01)

(58) Field of Classification Search
CPC ..... H04S 2400/01; H04S 2400/11; H04S 2400/13; H04R 3/04; H04R 5/04; H04R 5/033
See application file for complete search history.

(56) References Cited

OTHER PUBLICATIONS

Savell, Thomas C. (Mar. 2, 2014). "The EMU10K1 Digital Audio Processor," 1999 IEEE, Joint Emu/Creative Technology Center, WayBackMachine Archive, located at: https://web.archive.org/web/20140302033645/http:/alsa.cybermirror.org/manuals/creative/m2049.pdf.

VOGONS Vintage Driver Library. (May 7, 1999). "Sound Blaster Live! Install (VXD 4.06.610 Liveware 2.0)," VOGONS Forums, uploaded by Swaaye on Mar. 13, 2015, located at: http://vogonsdrivers.com/getfile.php?fileid=781&menustate=0.

Wikipedia. (Jun. 3, 2018). "Sound Blaster Live!," WayBackMachine Archive, located at: https://web.archive.org/web/20180603220605/https:/en.wikipedia.org/wiki/Sound_Blaster_Live! last edited on Jan. 20, 2018.

* cited by examiner

EMPHASIS FOR AUDIO SPATIALIZATION

REFERENCE TO RELATED APPLICATIONS

This application claims priority to U.S. Provisional Application No. 62/742,254, filed on Oct. 5, 2018, to U.S. Provisional Application No. 62/812,546, filed on Mar. 1, 2019, and to U.S. Provisional Application No. 62/742,191, filed on Oct. 5, 2018, the contents of which are incorporated by reference herein in their entirety.

FIELD

This disclosures relates generally to systems and methods for audio signal processing, and in particular to systems and methods for presenting audio signals in a mixed reality environment.

BACKGROUND

Immersive and believable virtual environments require the presentation of audio signals in a manner that is consistent with a user's expectations—for example, expectations that an audio signal corresponding to an object in a virtual environment will be consistent with that object's location in the virtual environment, and with a visual presentation of that object. Creating rich and complex soundscapes (sound environments) in virtual reality, augmented reality, and mixed-reality environments requires efficient presentation of a large number of digital audio signals, each appearing to come from a different location/proximity and/or direction in a user's environment. The soundscape includes a presentation of objects and is relative to a user; the positions and orientations of the objects and of the user may change quickly, requiring that the soundscape be adjusted accordingly. Adjusting a soundscape to believably reflect the positions and orientations of the objects and of the user can require rapid changes to audio signals that can result in undesirable sonic artifacts, such as "clicking" sounds, that compromise the immersiveness of a virtual environment. However, some techniques for reducing such sonic artifacts may be computationally expensive, particularly for mobile devices commonly used to interact with virtual environments. It is desirable for systems and methods of presenting soundscapes to a user of a virtual environment to accurately reflect the sounds of the virtual environment, while minimizing sonic artifacts and remaining computationally efficient.

BRIEF SUMMARY

Examples of the disclosure describe systems and methods for presenting an audio signal to a user of a wearable head device. According to an example method, a first input audio signal is received. The first input audio signal is processed to generate a first output audio signal. The first output audio signal is presented via one or more speakers associated with the wearable head device. Processing the first input audio signal comprises applying a pre-emphasis filter to the first input audio signal; adjusting a gain of the first input audio signal; and applying a de-emphasis filter to the first audio signal. Applying the pre-emphasis filter to the first input audio signal comprises attenuating a low frequency component of the first input audio signal. Applying the de-emphasis filter to the first input audio signal comprises attenuating a high frequency component of the first input audio signal.

DETAILED DESCRIPTION

In the following description of examples, reference is made to the accompanying drawings which form a part hereof, and in which it is shown by way of illustration specific examples that can be practiced. It is to be understood that other examples can be used and structural changes can be made without departing from the scope of the disclosed examples.

Example Wearable System

Figure 9:
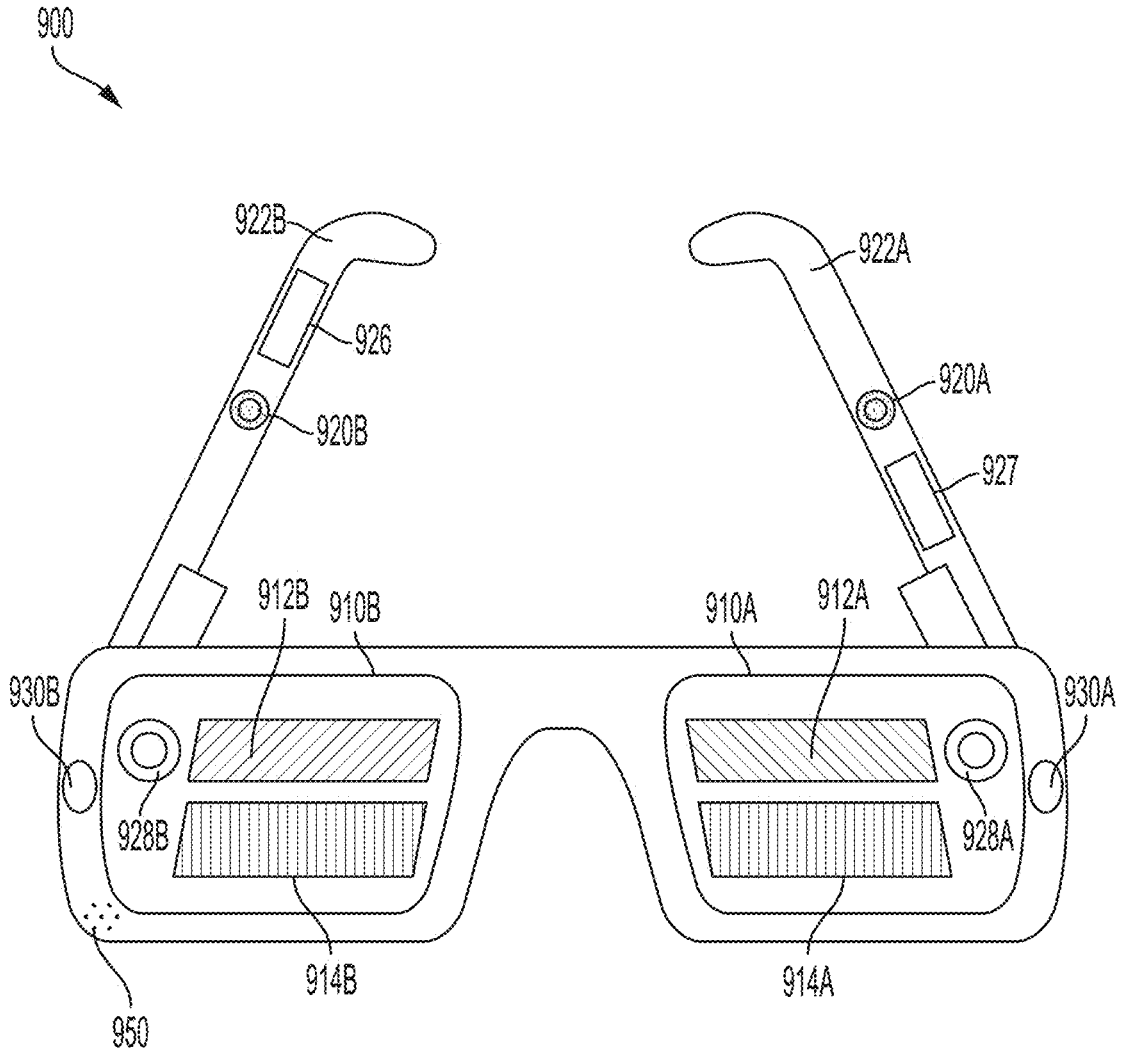
FIG. 9 illustrates an example wearable system, according to some embodiments of the disclosure.

FIG. 9 illustrates an example wearable head device 900 configured to be worn on the head of a user. Wearable head device 900 may be part of a broader wearable system that includes one or more components, such as a head device (e.g., wearable head device 900), a handheld controller (e.g., handheld controller 1000 described below), and/or an auxiliary unit (e.g., auxiliary unit 1100 described below). In some examples, wearable head device 900 can be used for virtual reality, augmented reality, or mixed reality systems or applications. Wearable head device 900 can include one or more displays, such as displays 910A and 910B (which may include left and right transmissive displays, and associated components for coupling light from the displays to the user's eyes, such as orthogonal pupil expansion (OPE) grating sets 912A/912B and exit pupil expansion (EPE) grating sets 914A/914B); left and right acoustic structures, such as speakers 920A and 920B (which may be mounted on temple arms 922A and 922B, and positioned adjacent to the user's left and right ears, respectively); one or more sensors such as infrared sensors, accelerometers, GPS units, inertial measurement units (IMUs, e.g. IMU 926), acoustic sensors (e.g., microphones 950); orthogonal coil electromagnetic receivers (e.g., receiver 927 shown mounted to the left temple arm 922A); left and right cameras (e.g., depth (time-of-flight) cameras 930A and 930B) oriented away from the user; and left and right eye cameras oriented toward the user (e.g., for detecting the user's eye movements)(e.g., eye cameras 928A and 928B). However, wearable head device 900 can incorporate any suitable display technology, and any suitable number, type, or combination of sensors or other components without departing from the scope of the disclosure. In some examples, wearable head device 900 may incorporate one or more microphones 950 configured to detect audio signals generated by the user's voice; such microphones may be positioned adjacent to the user's mouth. In some examples, wearable head device 900 may incorporate networking features (e.g., Wi-Fi capability) to communicate with other devices and systems, including other wearable systems. Wearable head device 900 may further include components such as a battery, a processor, a memory, a storage unit, or various input devices (e.g., buttons, touchpads); or may be coupled to a handheld controller (e.g., handheld controller 1000) or an auxiliary unit (e.g., auxiliary unit 1100) that includes one or more such components. In some examples, sensors may be configured to output a set of coordinates of the head-mounted unit relative to the user's environment, and may provide input to a processor performing a Simultaneous Localization and Mapping (SLAM) procedure and/or a visual odometry algorithm. In some examples, wearable head device 900 may be coupled to a handheld controller 1000, and/or an auxiliary unit 1100, as described further below.

Figure 10:
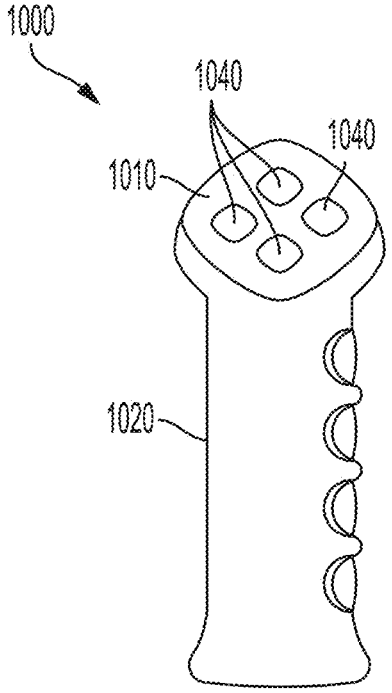
FIG. 10 illustrates an example handheld controller that can be used in conjunction with an example wearable system, according to some embodiments of the disclosure.

FIG. 10 illustrates an example mobile handheld controller component 200 of an example wearable system. In some examples, handheld controller 1000 may be in wired or wireless communication with wearable head device 900 and/or auxiliary unit 1100 described below. In some examples, handheld controller 1000 includes a handle portion 1020 to be held by a user, and one or more buttons 1040 disposed along a top surface 1010. In some examples, handheld controller 1000 may be configured for use as an optical tracking target; for example, a sensor (e.g., a camera or other optical sensor) of wearable head device 900 can be configured to detect a position and/or orientation of handheld controller 1000—which may, by extension, indicate a position and/or orientation of the hand of a user holding handheld controller 1000. In some examples, handheld controller 1000 may include a processor, a memory, a storage unit, a display, or one or more input devices, such as described above. In some examples, handheld controller 1000 includes one or more sensors (e.g., any of the sensors or tracking components described above with respect to wearable head device 900). In some examples, sensors can detect a position or orientation of handheld controller 1000 relative to wearable head device 900 or to another component of a wearable system. In some examples, sensors may be positioned in handle portion 1020 of handheld controller 1000, and/or may be mechanically coupled to the handheld controller. Handheld controller 1000 can be configured to provide one or more output signals, corresponding, for example, to a pressed state of the buttons 1940; or a position, orientation, and/or motion of the handheld controller 1000 (e.g., via an IMU). Such output signals may be used as input to a processor of wearable head device 900, to auxiliary unit 1100, or to another component of a wearable system. In some examples, handheld controller 1000 can include one or more microphones to detect sounds (e.g., a user's speech, environmental sounds), and in some cases provide a signal corresponding to the detected sound to a processor (e.g., a processor of wearable head device 900).

Figure 11:
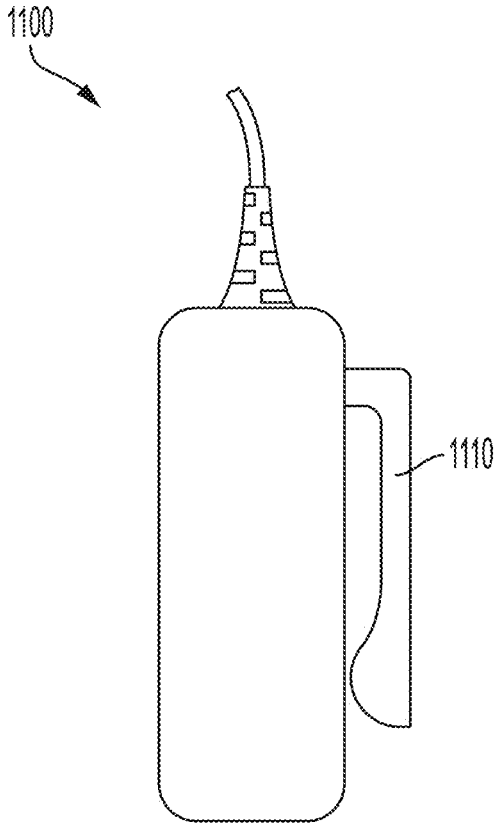
FIG. 11 illustrates an example auxiliary unit that can be used in conjunction with an example wearable system, according to some embodiments of the disclosure.

FIG. 11 illustrates an example auxiliary unit 1100 of an example wearable system. In some examples, auxiliary unit 1100 may be in wired or wireless communication with wearable head device 900 and/or handheld controller 1000. The auxiliary unit 1100 can include a battery to provide energy to operate one or more components of a wearable system, such as wearable head device 900 and/or handheld controller 1000 (including displays, sensors, acoustic structures, processors, microphones, and/or other components of wearable head device 900 or handheld controller 1000). In some examples, auxiliary unit 1100 may include a processor, a memory, a storage unit, a display, one or more input devices, and/or one or more sensors, such as described above. In some examples, auxiliary unit 1100 includes a clip 1110 for attaching the auxiliary unit to a user (e.g., a belt worn by the user). An advantage of using auxiliary unit 1100 to house one or more components of a wearable system is that doing so may allow large or heavy components to be carried on a user's waist, chest, or back—which are relatively well suited to support large and heavy objects—rather than mounted to the user's head (e.g., if housed in wearable head device 900) or carried by the user's hand (e.g., if housed in handheld controller 1000). This may be particularly advantageous for relatively heavy or bulky components, such as batteries.

Figure 12:
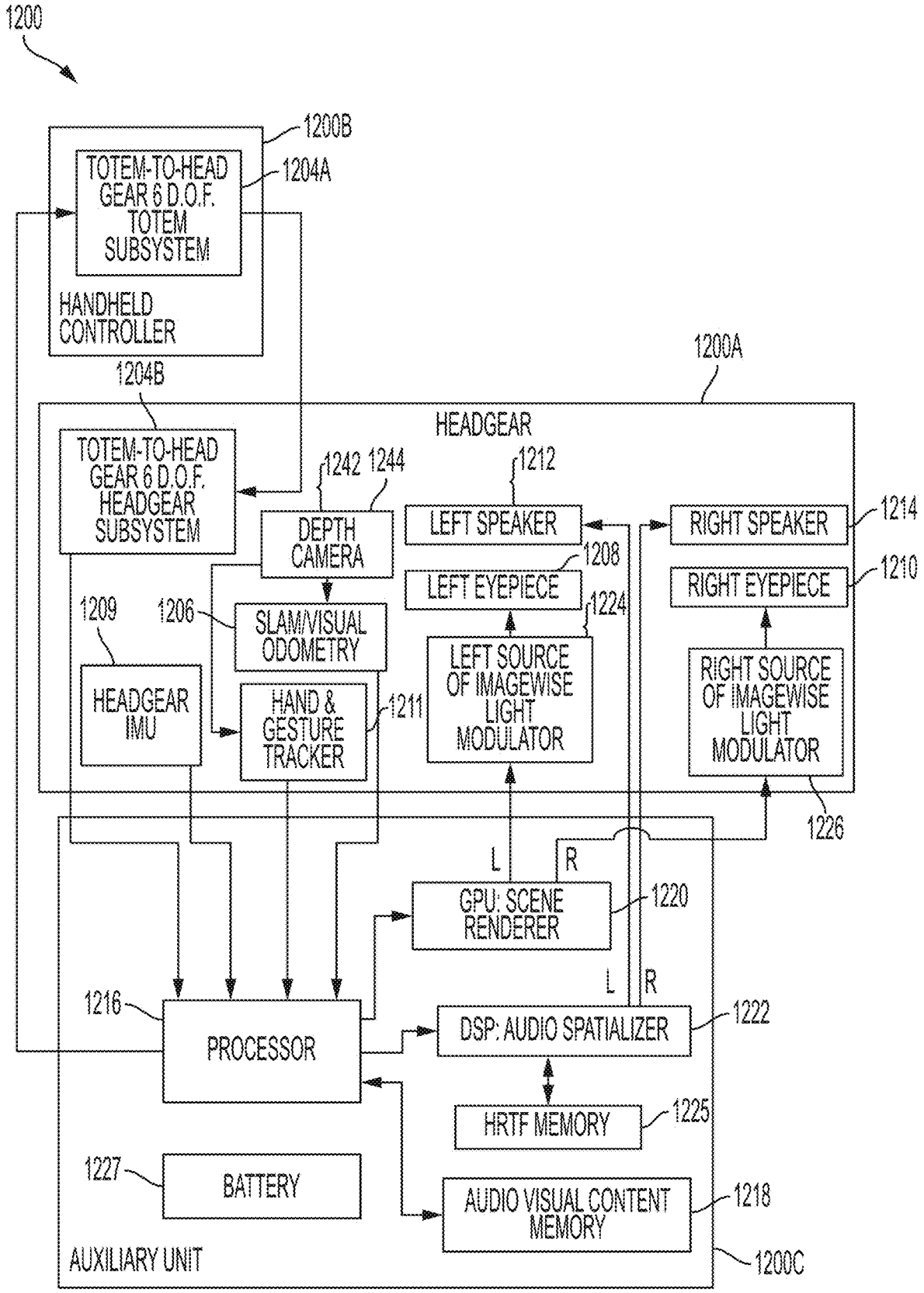
FIG. 12 illustrates an example functional block diagram for an example wearable system, according to some embodiments of the disclosure.

FIG. 12 shows an example functional block diagram that may correspond to an example wearable system 1200, such as may include example wearable head device 900, handheld controller 1000, and auxiliary unit 1100 described above. In some examples, the wearable system 1200 could be used for virtual reality, augmented reality, or mixed reality applications. As shown in FIG. 12, wearable system 1200 can include example handheld controller 1200B, referred to here as a "totem" (and which may correspond to handheld controller 1000 described above); the handheld controller 1200B can include a totem-to-headgear six degree of freedom (6DOF) totem subsystem 1204A. Wearable system 1200 can also include example headgear device 1200A (which may correspond to wearable head device 900 described above); the headgear device 1200A includes a totem-to-headgear 6DOF headgear subsystem 1204B. In the example, the 6DOF totem subsystem 1204A and the 6DOF headgear subsystem 1204B cooperate to determine six coordinates (e.g., offsets in three translation directions and rotation along three axes) of the handheld controller 1200B relative to the headgear device 1200A. The six degrees of freedom may be expressed relative to a coordinate system of the headgear device 1200A. The three translation offsets may be expressed as X, Y, and Z offsets in such a coordinate system, as a translation matrix, or as some other representation. The rotation degrees of freedom may be expressed as sequence of yaw, pitch and roll rotations; as vectors; as a rotation matrix; as a quaternion; or as some other representation. In some examples, one or more depth cameras 1244 (and/or one or more non-depth cameras) included in the headgear device 1200A; and/or one or more optical targets (e.g., buttons 1040 of handheld controller 1000 as described above, or dedicated optical targets included in the handheld controller) can be used for 6DOF tracking. In some examples, the handheld controller 1200B can include a camera, as described above; and the headgear device 1200A can include an optical target for optical tracking in conjunction with the camera. In some examples, the headgear device 1200A and the handheld controller 1200B each include a set of three orthogonally oriented solenoids which are used to wirelessly send and receive three distinguishable signals. By measuring the relative magnitude of the three distinguishable signals received in each of the coils used for receiving, the 6DOF of the handheld controller 1200B relative to the headgear device 1200A may be determined. In some examples, 6DOF totem subsystem 1204A can include an Inertial Measurement Unit (IMU) that is useful to provide improved accuracy and/or more timely information on rapid movements of the handheld controller 1200B.

In some examples involving augmented reality or mixed reality applications, it may be desirable to transform coordinates from a local coordinate space (e.g., a coordinate space fixed relative to headgear device 1200A) to an inertial coordinate space, or to an environmental coordinate space. For instance, such transformations may be necessary for a display of headgear device 1200A to present a virtual object at an expected position and orientation relative to the real environment (e.g., a virtual person sitting in a real chair, facing forward, regardless of the position and orientation of headgear device 1200A), rather than at a fixed position and orientation on the display (e.g., at the same position in the display of headgear device 1200A). This can maintain an illusion that the virtual object exists in the real environment (and does not, for example, appear positioned unnaturally in the real environment as the headgear device 1200A shifts and rotates). In some examples, a compensatory transformation between coordinate spaces can be determined by processing imagery from the depth cameras 1244 (e.g., using a Simultaneous Localization and Mapping (SLAM) and/or visual odometry procedure) in order to determine the transformation of the headgear device 1200A relative to an inertial or environmental coordinate system. In the example shown in FIG. 12, the depth cameras 1244 can be coupled to a SLAM/visual odometry block 1206 and can provide imagery to block 1206. The SLAM/visual odometry block 1206 implementation can include a processor configured to process this imagery and determine a position and orientation of the user's head, which can then be used to identify a transformation between a head coordinate space and a real coordinate space. Similarly, in some examples, an additional source of information on the user's head pose and location is obtained from an IMU 1209 of headgear device 1200A. Information from the IMU 1209 can be integrated with information from the SLAM/visual odometry block 1206 to provide improved accuracy and/or more timely information on rapid adjustments of the user's head pose and position.

In some examples, the depth cameras 1244 can supply 3D imagery to a hand gesture tracker 1211, which may be implemented in a processor of headgear device 1200A. The hand gesture tracker 1211 can identify a user's hand gestures, for example by matching 3D imagery received from the depth cameras 1244 to stored patterns representing hand gestures. Other suitable techniques of identifying a user's hand gestures will be apparent.

In some examples, one or more processors 1216 may be configured to receive data from headgear subsystem 1204B, the IMU 1209, the SLAM/visual odometry block 1206, depth cameras 1244, microphones 1250; and/or the hand gesture tracker 1211. The processor 1216 can also send and receive control signals from the 6DOF totem system 1204A. The processor 1216 may be coupled to the 6DOF totem system 1204A wirelessly, such as in examples where the handheld controller 1200B is untethered. Processor 1216 may further communicate with additional components, such as an audio-visual content memory 1218, a Graphical Processing Unit (GPU) 1220, and/or a Digital Signal Processor (DSP) audio spatializer 1222. The DSP audio spatializer 1222 may be coupled to a Head Related Transfer Function (HRTF) memory 1225. The GPU 1220 can include a left channel output coupled to the left source of imagewise modulated light 1224 and a right channel output coupled to the right source of imagewise modulated light 1226. GPU 1220 can output stereoscopic image data to the sources of imagewise modulated light 1224, 1226. The DSP audio spatializer 1222 can output audio to a left speaker 1212 and/or a right speaker 1214. The DSP audio spatializer 1222 can receive input from processor 1216 indicating a direction vector from a user to a virtual sound source (which may be moved by the user, e.g., via the handheld controller 1200B). Based on the direction vector, the DSP audio spatializer 1222 can determine a corresponding HRTF (e.g., by accessing a HRTF, or by interpolating multiple HRTFs). The DSP audio spatializer 1222 can then apply the determined HRTF to an audio signal, such as an audio signal corresponding to a virtual sound generated by a virtual object. This can enhance the believability and realism of the virtual sound, by incorporating the relative position and orientation of the user relative to the virtual sound in the mixed reality environment—that is, by presenting a virtual sound that matches a user's expectations of what that virtual sound would sound like if it were a real sound in a real environment.

In some examples, such as shown in FIG. 12, one or more of processor 1216, GPU 1220, DSP audio spatializer 1222, HRTF memory 1225, and audio/visual content memory 1218 may be included in an auxiliary unit 1200C (which may correspond to auxiliary unit 1100 described above). The auxiliary unit 1200C may include a battery 1227 to power its components and/or to supply power to headgear device 1200A and/or handheld controller 1200B. Including such components in an auxiliary unit, which can be mounted to a user's waist, can limit the size and weight of headgear device 1200A, which can in turn reduce fatigue of a user's head and neck.

While FIG. 12 presents elements corresponding to various components of an example wearable system 1200, various other suitable arrangements of these components will become apparent to those skilled in the art. For example, elements presented in FIG. 12 as being associated with auxiliary unit 1200C could instead be associated with headgear device 1200A or handheld controller 1200B. Furthermore, some wearable systems may forgo entirely a handheld controller 1200B or auxiliary unit 1200C. Such changes and modifications are to be understood as being included within the scope of the disclosed examples.

Audio Spatialization

The systems and methods described below can be implemented in an augmented reality or mixed reality system, such as described above. For example, one or more processors (e.g., CPUs, DSPs) of an augmented reality system can be used to process audio signals or to implement steps of computer-implemented methods described below; sensors of the augmented reality system (e.g., cameras, acoustic sensors, IMUs, LIDAR, GPS) can be used to determine a position and/or orientation of a user of the system, or of elements in the user's environment; and speakers of the augmented reality system can be used to present audio signals to the user.

In augmented reality or mixed reality systems such as described above, one or more processors (e.g., DSP audio spatializer 1222) can process one or more audio signals for presentation to a user of a wearable head device via one or more speakers (e.g., left and right speakers 1212/1214 described above). In some embodiments, the one or more speakers may belong to a unit separate from the wearable head device (e.g., a pair of headphones in communication with the wearable head device). Processing of audio signals requires tradeoffs between the authenticity of a perceived audio signal—for example, the degree to which an audio signal presented to a user in a mixed reality environment matches the user's expectations of how an audio signal would sound in a real environment—and the computational overhead involved in processing the audio signal. Realistically spatializing an audio signal in a virtual environment can be critical to creating immersive and believable user experiences.

Figure 1A:
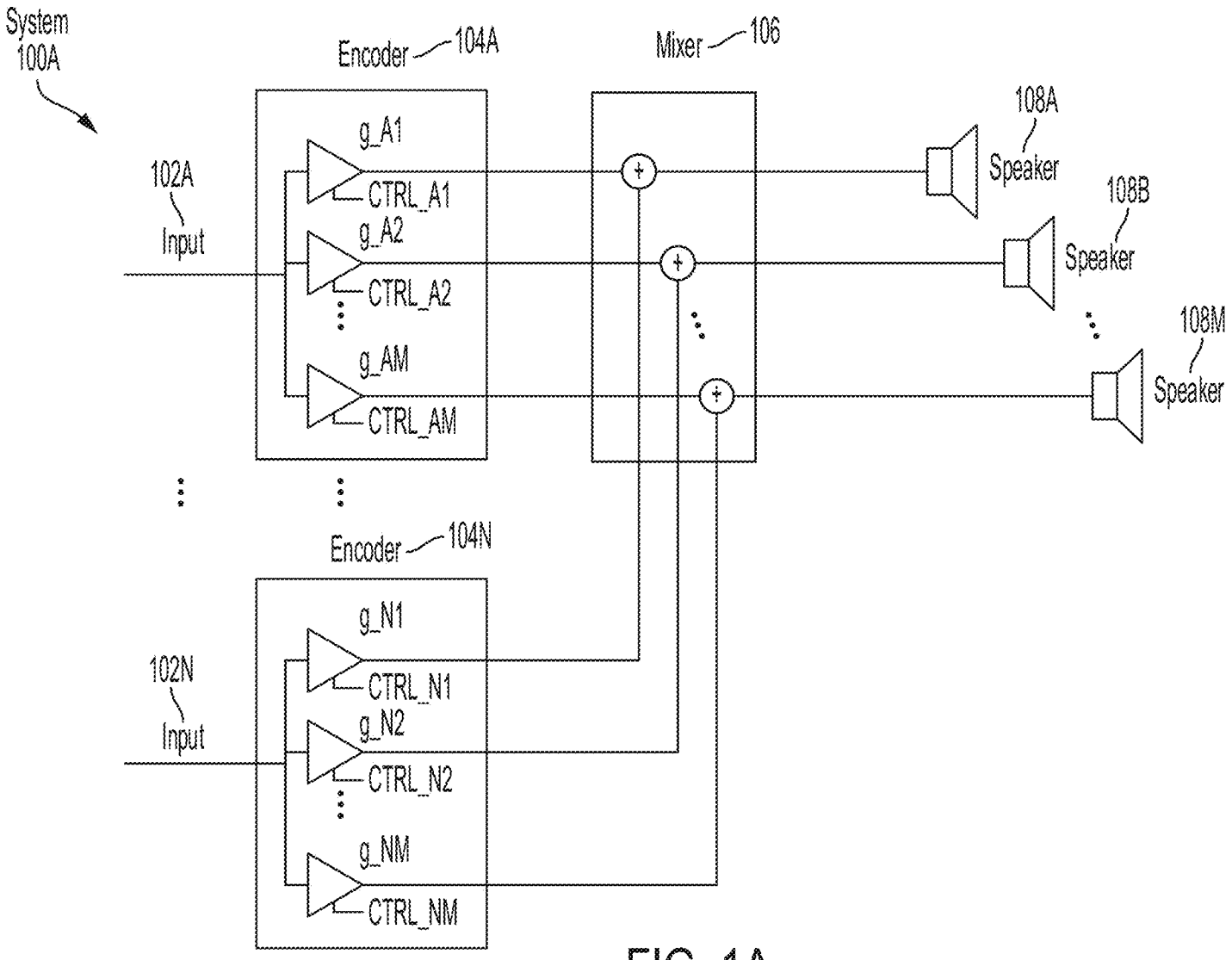
FIGS. 1A-1B illustrate example audio spatialization systems, according to some embodiments of the disclosure.

FIG. 1A illustrates a spatialization system 100A (hereinafter referred to as "system 100A"), according to some embodiments. The system 100A includes one or more encoders 104A-N, a mixer 106, and one or more speakers 108A-M. The system 100A creates a soundscape (sound environment) by spatializing input sounds/signals corresponding to objects to be presented in the soundscape, and delivers the soundscape through the one or more speakers 108A-M.

The system 100A receives one or more input signals 102A-N. The one or more input signals 102A-N may include digital audio signals corresponding to the objects to be presented in the soundscape. In some embodiments, the digital audio signals may be a pulse-code modulated (PCM) waveform of audio data. The total number of input signals (N) may represent the total number of objects to be presented in the soundscape.

Each encoder of the one or more encoders 104A-N receives at least one input signal of the one or more input signals 102A-N and outputs one or more gain adjusted signals. For example, in some embodiments, encoder 104A receives input signal 102A and outputs gain adjusted signals. In some embodiments, each encoder outputs a gain adjusted signal for each speaker of the one or more speakers 108A-M delivering the soundscape. For example, encoder 104 outs M gain adjusted signals for each of the speakers 108A-M. Speakers 108A-M may belong to an augmented reality or mixed reality system such as described above; for example, one or more of speakers 108A-M may belong to a wearable head device such as described above and may be configured to present an audio signal directly to an ear of a user wearing the device. In order to make the objects in the soundscape appear to originate from specific locations/proximities, each encoder of the one or more encoders 104A-N accordingly sets values of control signals input to the gain modules.

Each encoder of the one or more encoders 104A-N includes one or more gain modules. For example, encoder 104A includes gain modules g_A1-AM. In some embodiments, each encoder of the one or more encoders 104A-N in the system 100A may include the same number of gain modules. For example, each of the one or more encoders 104A-N may each include M gain modules. In some embodiments, the total number of gain modules in an encoder corresponds to a total number of speakers delivering the soundscape. Each gain module receives at least one input signal of the one or more input signals 102A-N, adjusts a gain of the input signal, and outputs a gain adjusted signal. For example, gain module g_A1 receives input signal 102A, adjusts a gain of the input signal 102A, and outputs a gain adjusted signal. Each gain module adjusts the gain of the input signal based on a value of a control signal of one or more control signals CTRL_A1-NM. For example, gain module g_A1 adjusts the gain of the input signal 102A based on a value of control signal CTRL_A1. Each encoder adjusts values of control signals input to the gain modules based on a location/proximity of the object to be presented in the soundscape the input signal corresponds to. Each gain module may be a multiplier that multiplies the input signal by a factor that is a function of a value of a control signal.

The mixer 106 receives gain adjusted signals from the encoders 104A-N, mixes the gain adjusted signals, and outputs mixed signals to the speakers 108A-M. The speakers 108A-M receive mixed signals from the mixer 106 and output sound. In some embodiments, the mixer 106 may be removed from the system 100A if there is only one input signal (e.g., input 102A).

In some embodiments, to perform this operation, a spatialization system ("spatializer") processes each input signal (e.g., digital audio signal ("source')) with a pair of Head-Related Transfer Function (HRTF) filters that simulate propagation and diffraction of sound through and by an outer ear and head of a user. The pair of HRTF filters include a HRTF filter for a left ear of the user and a HRTF filter for a right ear of the user. The outputs of the left ear HRTF filters for all sources are mixed together and played through a left ear speaker, and the outputs of the right ear HRTF filters for all sources are mixed together and played through a right ear speaker.

Figure 1B:
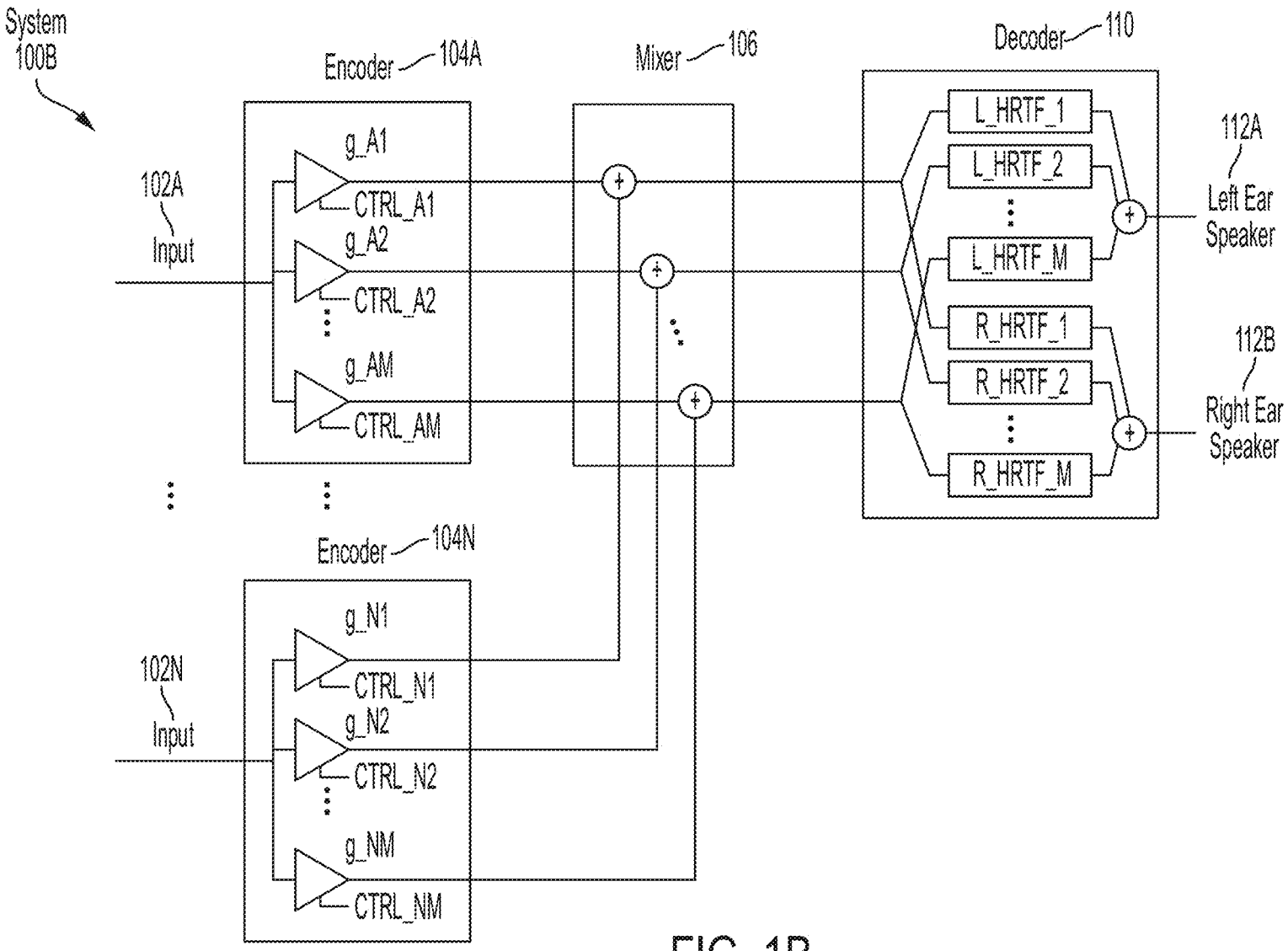

FIG. 1B illustrates a spatialization system 100B (hereinafter referred to as "system 100B"), according to some embodiments. The system 100B creates a soundscape (sound environment) by spatializing input sounds/signals. The system 100B illustrated in FIG. 1B is similar to the system 100A illustrated in FIG. 1A but may differ in some respects. For example, in the example system 100A, the outputs of the mixer 106 are input to the speakers 108A-M. In the system 100B, the outputs of the mixer 106 are input to a decoder 110 and the outputs of the decoder 110 are input to a left ear speaker 112A and a right ear speaker 112B (hereinafter collectively referred to as "speakers 112"). In some embodiments, the mixer 106 may be removed from the system 100A if there is only one input signal (e.g., input 102A).

In the example, the decoder 110 includes left HRTF filters L_HRTF_1-M and right HRTF filters R_HRTF_1-M. The decoder 110 receives mixed signals from the mixer 106, filters and sums the mixed signals, and outputs filtered signals to the speakers 112. For example, the decoder 110 receives a first mixed signal from the mixer 106 representing a first object to be presented in the soundscape. Continuing the example, the decoder 110 processes the first mixed signal through a first left HRTF filter L_HRTF_1 and a first right HRTF filter R_HRTF_1. Specifically, the first left HRTF filter L_HRTF_1 filters the first mixed signal and outputs a first left filtered signal, and the first right HRTF filter R_HRTF_1 filters the first mixed signal and outputs a first right filtered signal. The decoder 110 sums the first left filtered signal with other left filtered signals, for example, output from the left HRTF filters L_HRTF_2-M, and outputs a left output signal to the left ear speaker 112A. The decoder 110 sums the first right filtered signal with other right filtered signals, for example, output from the right HRTF filters R_HRTF_2-M, and outputs a right output signal to the right ear speaker 112B.

In some embodiments, the decoder 110 may include a bank of HRTF filters. Each of the HRTF filters in the bank may model a specific direction relative to a user's head. In some embodiments, computationally efficient rendering methods may be used wherein incremental processing cost per virtual sound source is minimized. These methods may be based on decomposition of HRTF data over a fixed set of spatial functions and a fixed set of basis filters. In these embodiments, each mixed signal from the mixer 106 may be mixed into inputs of the HRTF filters that model directions that are closest to a source's direction. The levels of the signals mixed into each of those HRTF filters is determined by the specific direction of the source.

If directions and/or locations of the objects presented in the soundscape change, the encoders 104A-N can change the value of the control signals CTRL_A1-NM for the gain modules g_A1-NM to appropriately present the objects in the soundscape.

In some embodiments, the encoders 104A-N may change the values of the control signals CTRL_A1-NM for the gain modules g_A1-NM instantaneously. However, changing the values of the control signals CTRL_A1-NM instantaneously for the system 100A of FIG. 1A and/or the system 100B of FIG. 1B may result in sonic artifacts at the speakers 108A-M in the system 100A and/or the speakers 112 in the system 100B. A sonic artifact may be, for example, a 'click' sound. The severity of the sonic artifacts due to instantaneously changing the values of the control signals may be dependent on a combination of an amount of gain change and an amplitude of the input signal at the time of the gain change.

To reduce such sonic artifacts, in some embodiments, the encoders 104A-N may change the values of the control signals CTRL_A1-NM for the gain modules g_A1-NM over a period of time, rather than instantaneously. In some embodiments, the encoders 104A-N may compute new values for the control signals CTRL_A1-NM for each and every sample of the input signals 102A-N. The new values for the control signals CTRL_A1-NM may be only slightly different than previous values. The new values may follow a linear curve, an exponential curve, etc. This process may repeat until the required mixing levels for the new direction/location is/are reached. However, computing new values for the control signals CTRL_A1-NM for each and every sample of the input signals 102A-N for the system 100A of FIG. 1A and/or the system 100B of FIG. 1B may be computationally expensive and time consuming.

In some embodiments, the encoders 104A-N may compute new values for the control signals CTRL_A1-NM repeatedly, for example, once every several samples, every two samples, every four samples, every ten samples, and the like. This process may repeat until the required mixing levels for the new direction/location is reached. However, computing new values for the control signals CTRL_A1-NM once every several samples for the system 100A of FIG. 1A and/or the system 100B of FIG. 1B may result in sonic artifacts at the speakers 108A-M in the system 100A and/or the speakers 112 in system 100B. A sonic artifact may be, for example, a 'zipping' sound.

To reduce sonic artifacts, in some embodiments, an encoder may search an input signal for a zero crossing and, at a point in time of the zero crossing, adjust values of control signals. In some embodiments, it may take many computing cycles for the encoder to search the input signal for a zero crossing and, at the point in time of the zero crossing, adjust the values of the control signals. However, if the input signal has a direct-current (DC) bias, the encoder may never detect or determine a zero crossing in the input signal and so would never adjust the value of the control signals. As such, a high pass filter or a DC blocking filter may be introduced before the encoder to reduce/remove the DC bias and ensure there are enough zero crossings in the signal. In some embodiments of a system (e.g., the system 100A and/or the system 100B), a high pass filters or a DC blocking filters may be introduced before each encoder in the system. Once the DC bias is reduced/removed from the input signal, the encoder may search the input signal without the DC bias for a zero crossing and, at the point in time of the zero crossing, adjust values of control signals. Searching for zero crossings may be time consuming. If the system includes other components or modules that make changes to a signal, those other components or modules would similarly search signals input to the other component or module for a zero crossing and, at a point in time of the zero crossing, adjust values of parameters of various components or modules.

Figure 2A:
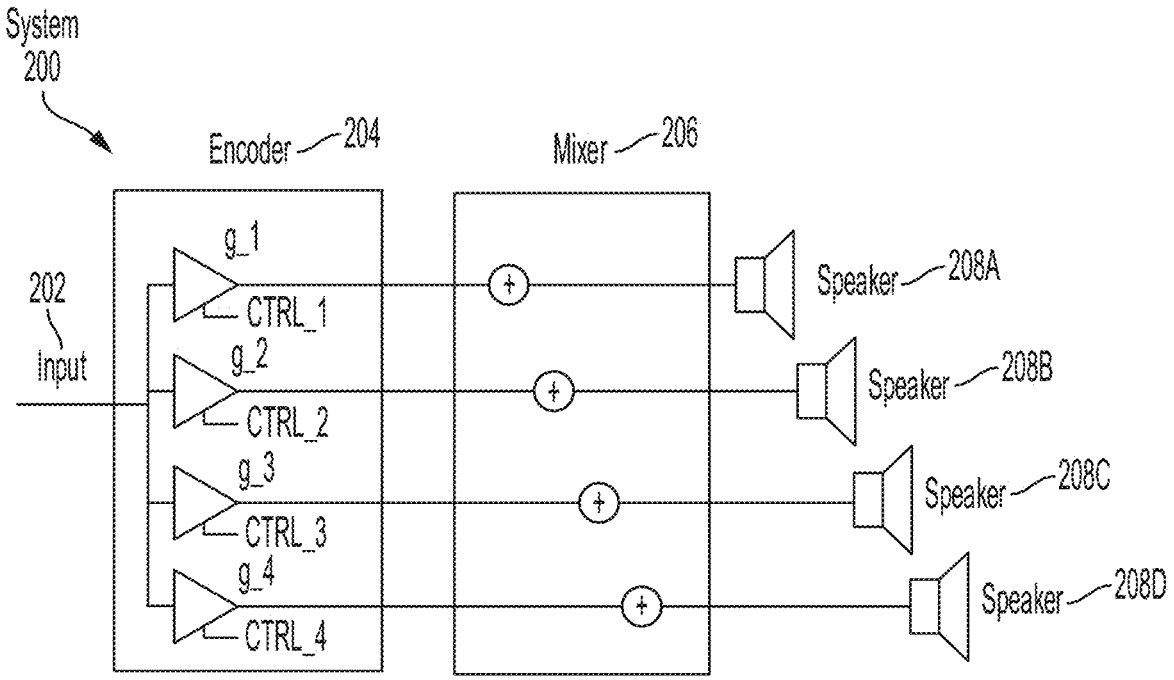
FIGS. 2A-2H illustrate example audio spatialization systems, according to some embodiments of the disclosure.

As a non-limiting example, FIG. 2A illustrates a system 200 including an encoder 204, a mixer 206, and first through fourth speakers 208A-D. The example system 200 is similar to the system 100A but may differ in some respects. The system 200 creates a soundscape (sound environment) by spatializing an input sound/signal corresponding to an object to be presented in the soundscape, and delivers the soundscape through the first through fourth speakers 208A-D.

The system 200 receives an input signal 202. The input signal 202 may include a digital audio signal corresponding to an object to be presented in a soundscape. The encoder 204 receives the input signal 202 and outputs four gain adjusted signals. The encoder 204 outputs a gain adjusted signal for each speaker of the first through fourth speakers 208A-D delivering the soundscape. In order to make the object in the soundscape appear to originate from a specific location/proximity, the encoder 204 accordingly sets values of control signals input to first through fourth gain modules g_1-4. The encoder 204 includes first through fourth gain modules g_1-4. The total number of gain modules corresponds to a total number of speakers delivering the soundscape. Each gain module of the first through fourth gain modules g_1-4 receives the input signal 202, adjusts a gain of the input signal 202, and outputs a gain adjusted signal. Each gain module of the first through fourth gain modules g_1-4 adjusts the gain of the input signal 202 based on a value of a control signal of first through fourth control signals CTRL_1-4. For example, the first gain module g_1 adjusts the gain of the input signal 202 based on a value of the first control signal CTRL_1. The encoder 204 adjusts the values of the first through fourth control signals CTRL_1-4 input to the first through fourth gain modules g_1-4 based on a location and/or proximity of the object to be presented in the soundscape the input signal 202 corresponds to. The mixer 206 receives gain adjusted signals from the encoder 204, mixes the gain adjusted signals, and outputs mixed signals to the first through fourth speakers 208A-D. In this example, because there is only one input signal 202 and only one encoder 204, the mixer 206 does not mix any gain adjusted signals. The first through fourth speakers 208A-D receive mixed signals from the mixer 106 and output sound.

Figure 2B:
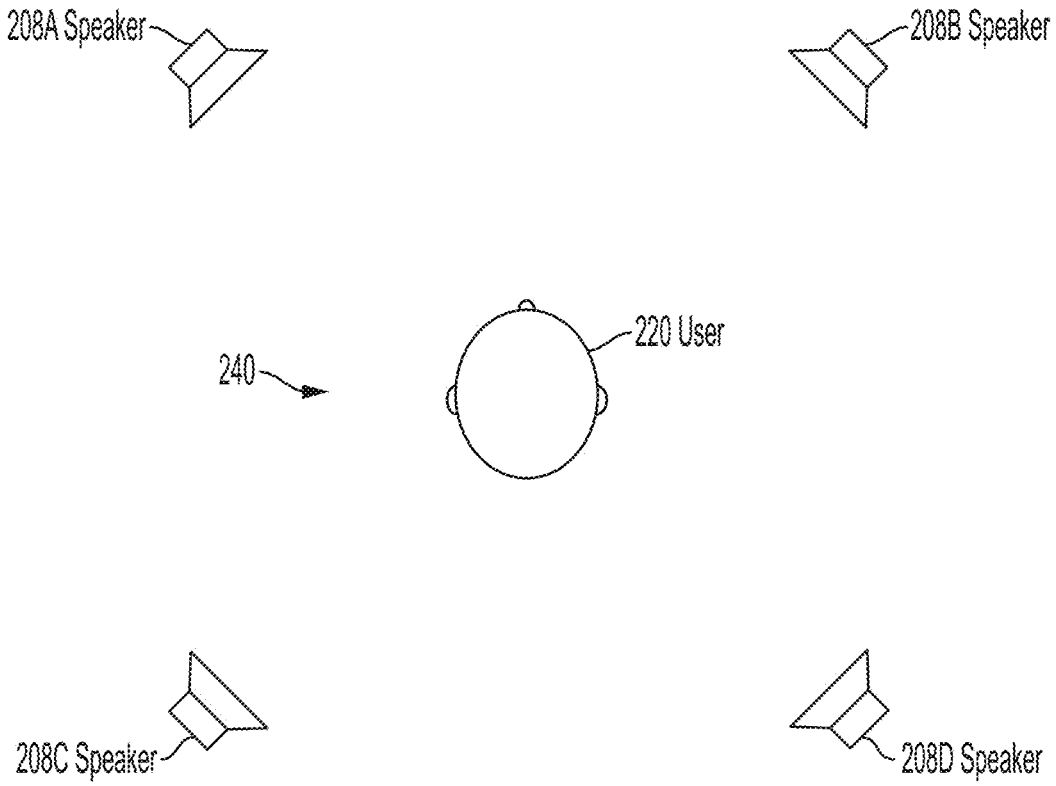
Figure 2C:
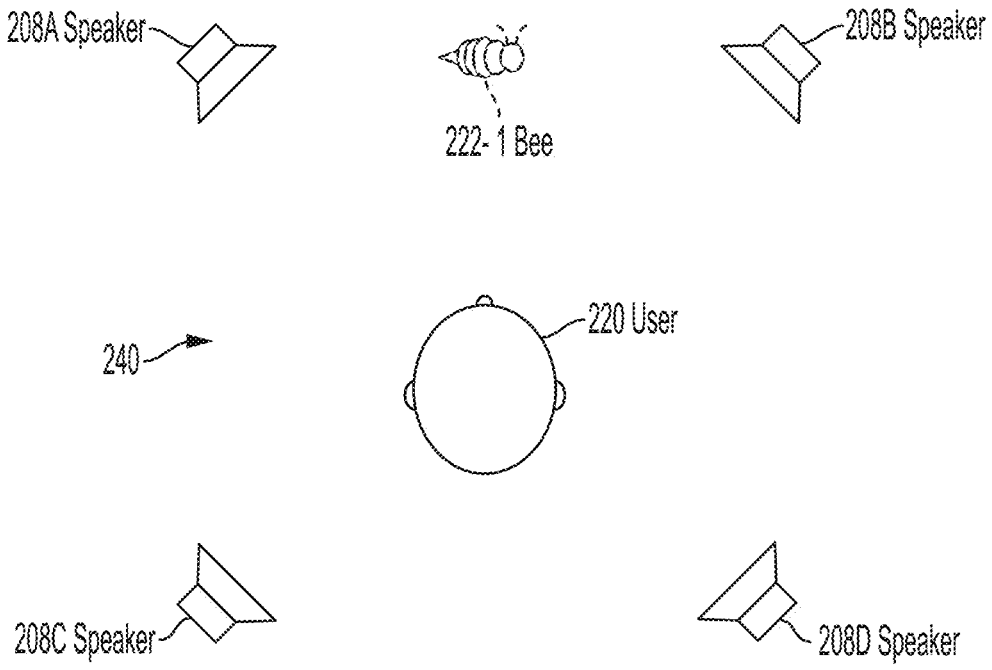
Figure 2D:
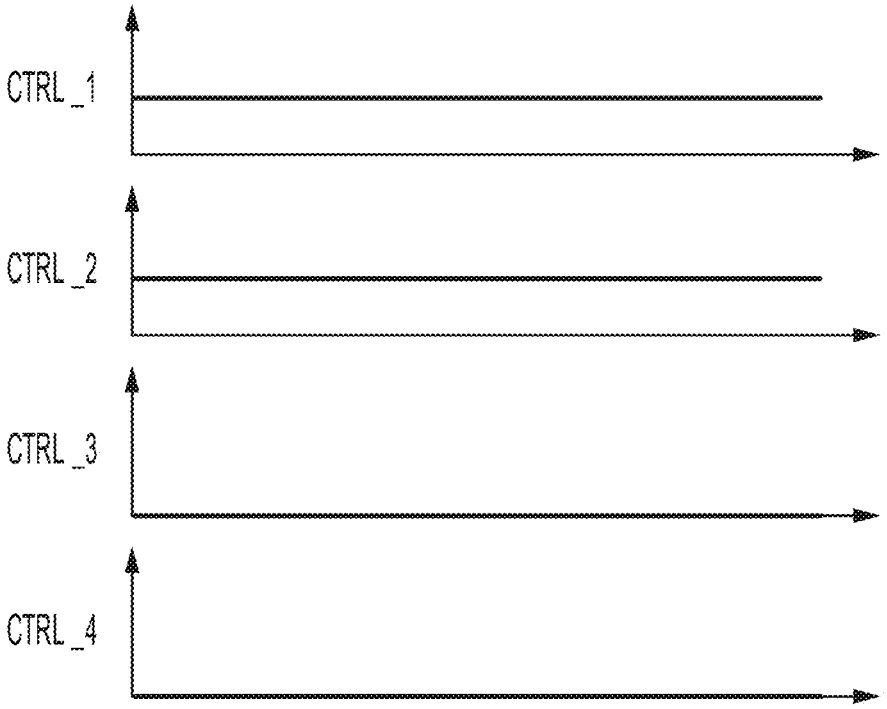

FIG. 2B illustrates an environment 240 including the first through fourth speakers 208A-D and a user 220. Speakers 208A-D may belong to an augmented reality system (e.g., including a wearable head device), and user 220 may be a user of the augmented reality system. FIG. 2C illustrates a virtual bee 222-1 at a first location/proximity in the environment 240. The virtual bee 222-1 is the object that is to be presented in the soundscape delivered by the first through fourth speakers 208A-D. The virtual bee 222-1 may be presented visually in a display of an augmented reality system in use by the user 220; it is generally desirable for the soundscape to be consistent with the visual display of the virtual bee 222-1. The encoder 204 receives the input signal 202 including a digital audio signal corresponding to the virtual bee 222-1. The encoder 204 sets the values of the first through fourth control signals CTRL_1-4 based on the first location/proximity of the virtual bee 222-1. FIG. 2D illustrates values of the first through fourth control signals CTRL_1-4 based on the first location/proximity of the virtual bee 222-1 depicted in FIG. 2C. As illustrated in FIG. 2D, the first and second control signals CTRL_1-2 have a same non-zero value (e.g., 0.5) and the third and fourth control signals CTRL_3-4 have a zero value based on the first location/proximity of the virtual bee 222-1 relative to the user 220. That is, since the virtual bee 222-1 is to be presented in the soundscape as being directly in front of the user 220, the first and second control signals CTRL_1-2 have the same non-zero value and the third and fourth control signals CTRL_3-4 have a zero value.

Figure 2E:
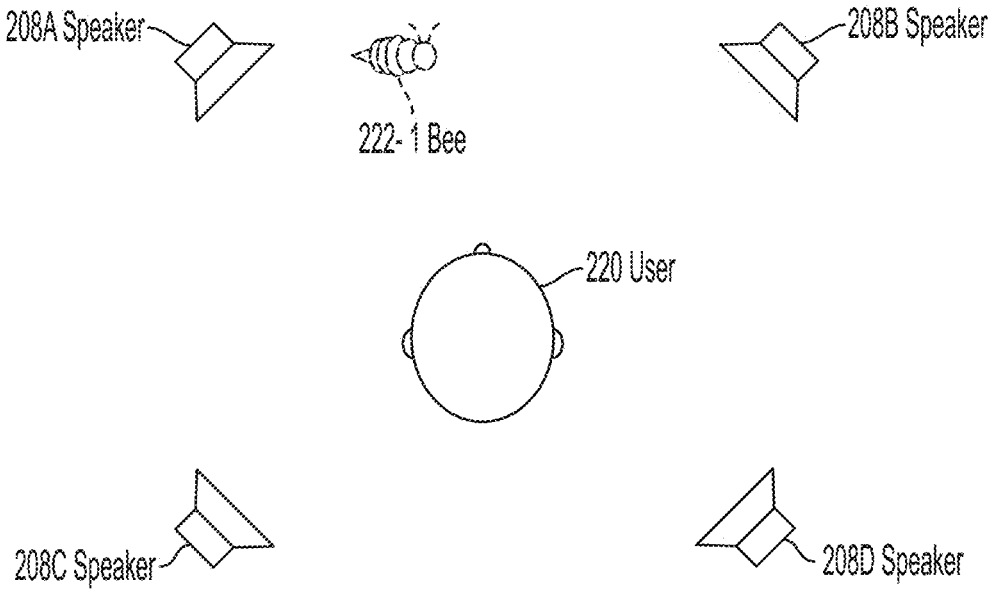

FIG. 2E illustrates a virtual bee 222-2 at a second location/proximity in the environment 240. The encoder 204 adjusts the values of the first through fourth control signals CTRL_1-4 based on the second location/proximity of the virtual bee 222-2. For example, the encoder 204 increases the value of the first control signal CTRL_1 relative to the value of the first control signal CTRL_1 when the virtual bee 222-1 was at the first location/proximity (e.g., value of 0.75), the encoder 204 decreases the value of second control signal CTRL_2 relative to the value of the second control signal CTRL_2 when the virtual bee 222-1 was at the first location/proximity (e.g., value of 0.25), and the encoder 204 does not make any adjustments to the third through fourth control signals CTRL_3-4 which remain zero value.

Figure 2F:
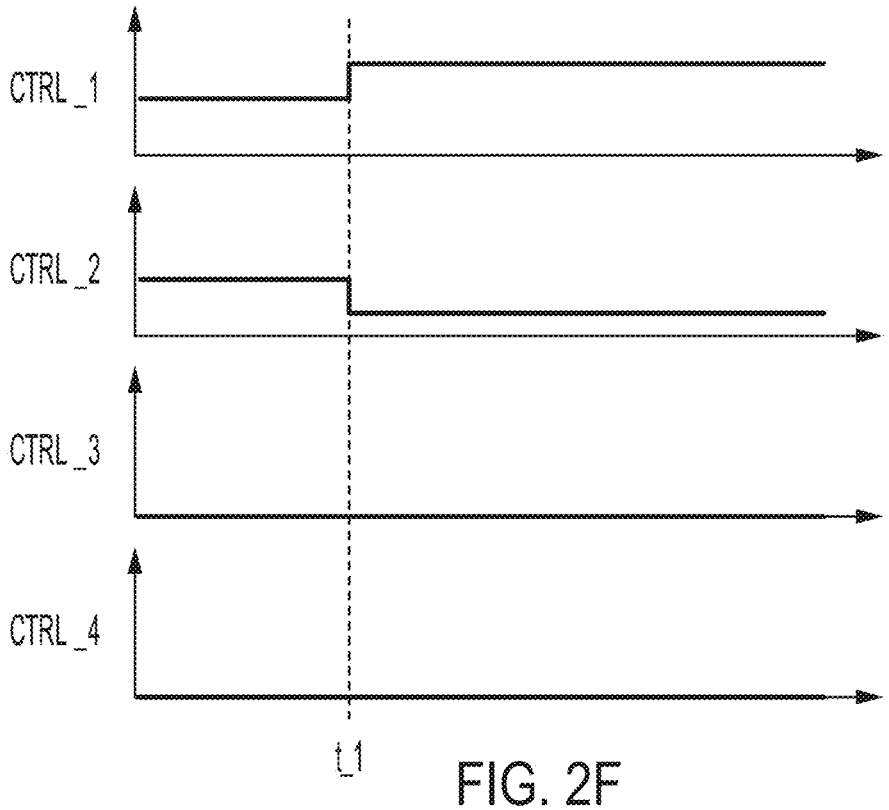

FIG. 2F illustrates values of the first through fourth control signals CTRL_1-4 based on the second location/proximity of the virtual bee 222-2 depicted in FIG. 2E, according to some embodiments. As illustrated in FIG. 2F, the encoder 204 changes the values of the first and second control signals CTRL_1-2 instantaneously at time t 1. As described above, changing the values of the first and second control signals CTRL_1-2 instantaneously at time t 1 may result in undesirable sonic artifacts at the speakers 208A-D. A sonic artifact may be, for example, a 'click' sound.

Figure 2G:
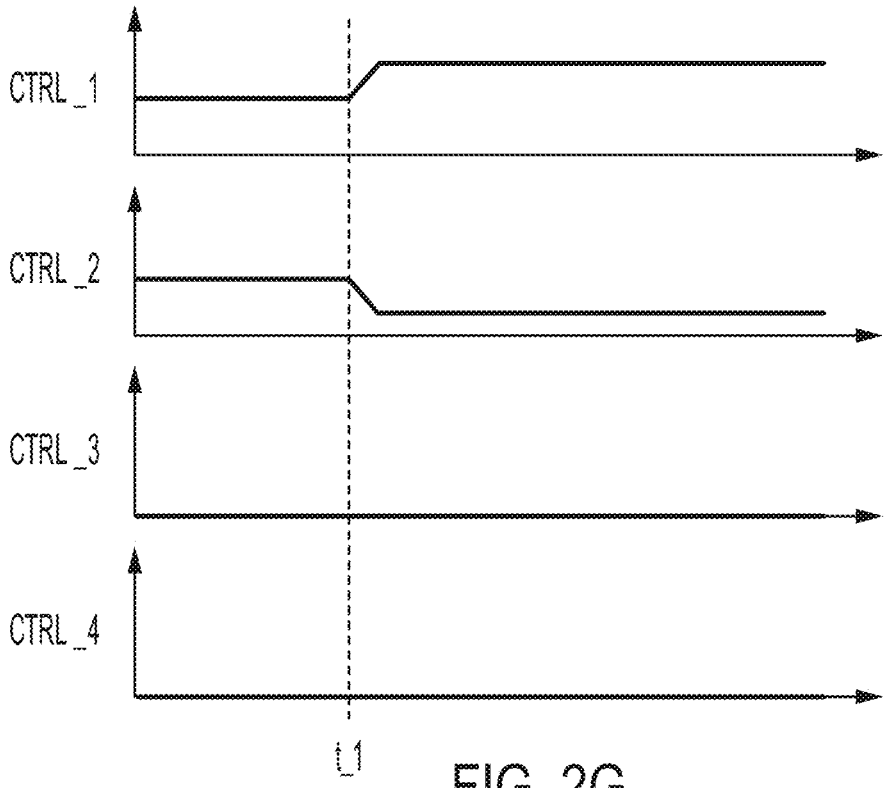

FIG. 2G illustrates values of the first through fourth control signals CTRL_1-4 based on the second location/proximity of the virtual bee 222-2 depicted in FIG. 2E, according to some embodiments. As illustrated in FIG. 2G, the encoder 204 changes the values of the first and second control signals CTRL_1-2 over a period of time. In this embodiment, the encoder 204 may compute new values for the first and second control signals CTRL_1-2 for each and every sample of the input signal 202. The new values for the first and second control signals CTRL_1-2 may be only slightly different than previous values. This process may repeat until the required mixing levels for the new direction/location is/are reached. For example, the process may repeat until the value of the first control signal CTRL_1 is increased (e.g., from 0.5 to 0.75) and the value of the second control signal CTRL_2 is decreased (e.g., from 0.5 to 0.25). However, as mentioned above, computing new values for the first and second control signals CTRL_1-2 for each and every sample of the input signals 202 may be computationally expensive and time consuming.

Figure 2H:
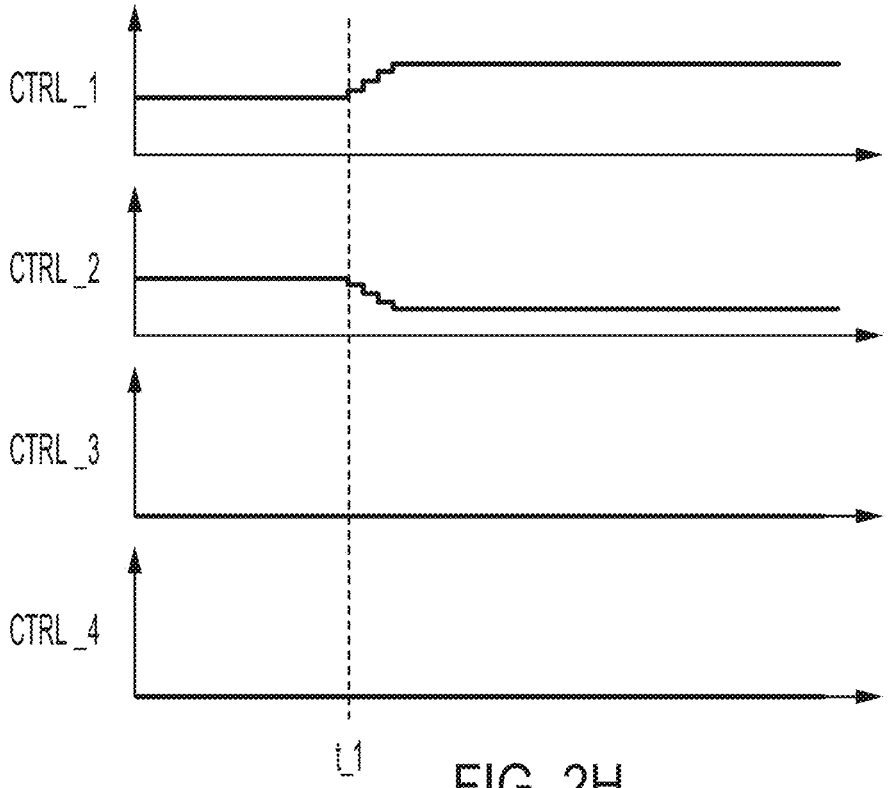

FIG. 2H illustrates values of the first through fourth control signals CTRL_1-4 based on the second location/proximity of the virtual bee 222-2 depicted in FIG. 2E, according to some embodiments. As illustrated in FIG. 2H, the encoder 204 changes the values of the first and second control signals CTRL_1-2 over a period of time. In this embodiment, the encoder 204 may compute new values for the first and second control signals CTRL_1-2 once every several samples. This process may repeat until the required mixing levels for the new direction/location is/are reached. However, as described above, computing new values for the first and second control signals CTRL_1-2 once every several samples may result in undesirable sonic artifacts at the speakers 208A-D. A sonic artifact may be, for example, a 'zipping' sound.

Figure 3A:
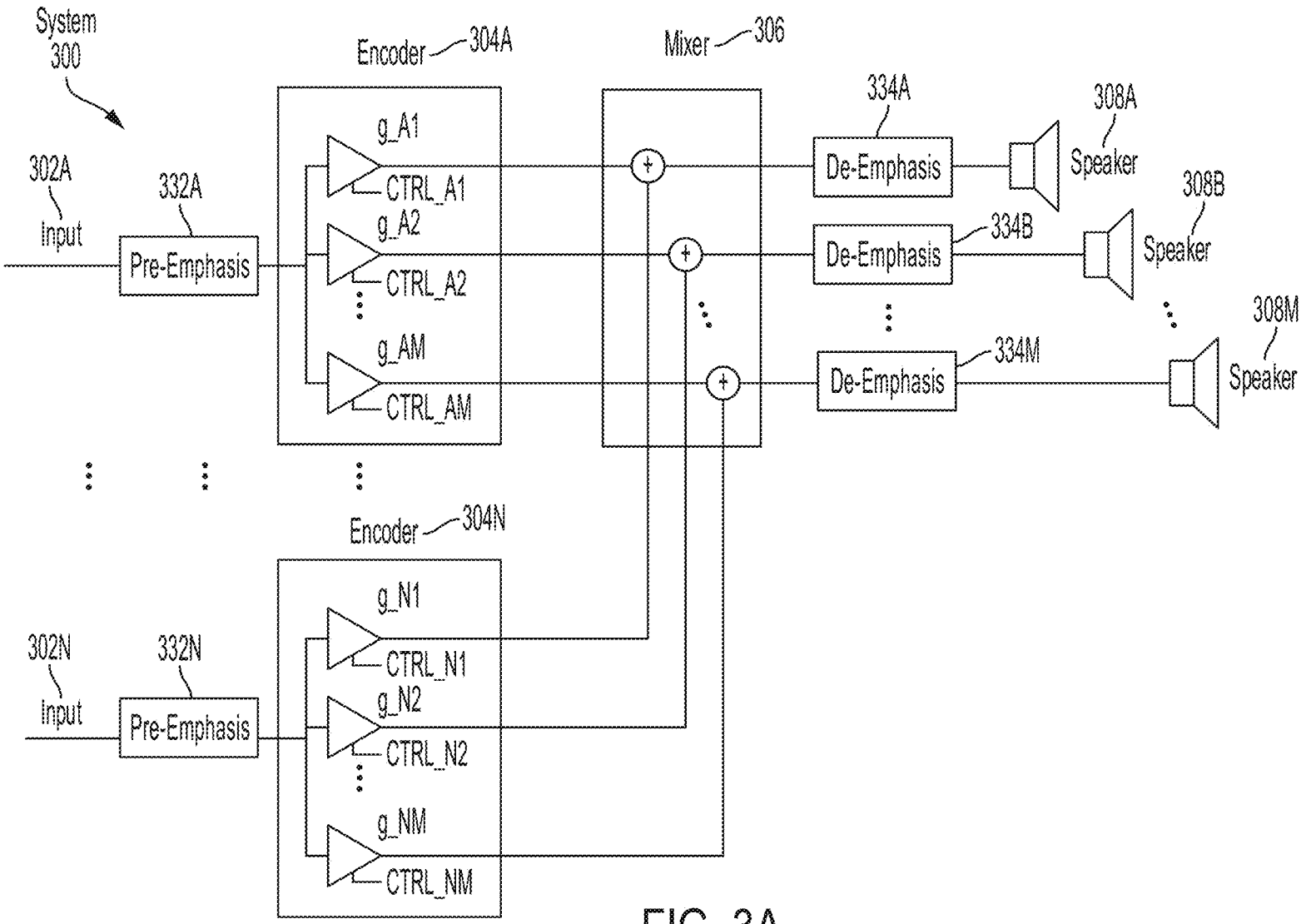
FIG. 3A illustrates an example audio spatialization system including pre-emphasis and de-emphasis filters, according to some embodiments of the disclosure.

FIG. 3A illustrates a spatialization system 300 (hereinafter referred to as "system 300"), according to some embodiments. The example system 300 creates a soundscape (sound environment) by spatializing input sounds/signals. The system 300 illustrated in FIG. 3 is similar to the system 100A illustrated in FIG. 1A but may differ in some respects. In addition to one or more encoders 304A-N, a mixer 306, and one or more speakers 308A-M, the system 300 includes one or more pre-emphasis filters 332A-N and one or more de-emphasis filters 334A-M. The addition of the one or more pre-emphasis filters 332A-N and the one or more de-emphasis filters 334A-M enable the one or more encoders 304A-N to change values of the control signals CTRL_A1-NM instantaneously while minimizing sonic artifacts at the speakers 308A-M. In some embodiments, the one or more pre-emphasis filters 332A-N and the one or more de-emphasis filters 334A-N reduce noise. The one or more pre-emphasis filters 332A-N and the one or more de-emphasis filters 334A-N may be complementary filters. The one or more pre-emphasis filters 332A-N and the one or more de-emphasis filters 334A-N may cancel each other out except, in some cases, at low frequencies where DC is blocked.

In the example, each pre-emphasis filter of the one or more pre-emphasis filters 332A-N receives at least one input signal of the one or more input signals 302A-N, filters the input signal, and outputs a filtered signal to an encoder of the one or more encoders 304A-N. Each pre-emphasis filter filters at least one input signal, for example, by reducing low frequency energy from the input signal. An amplitude of a filtered signal output from the pre-emphasis filter may be closer to zero than the amplitude of the input signal. The severity of the sonic artifacts, which may be due to instantaneously changing the values of the control signals which may be dependent on a combination of the amount of gain change and the amplitude of the input signal at the time of the gain change, may be lessened by the amplitude of the filtered signal being close to zero.

In the example, each encoder of the one or more encoders 304A-N can adjust values of control signals input to gain modules based on a location/proximity of an object to be presented in the soundscape that the input signal, and therefore the filtered signal, corresponds to. Each encoder may adjust the values of the control signals instantaneously without resulting in sonic artifacts at the speakers 308A-M. This is because each gain module adjusts a gain of the filtered signal (e.g., the output of pre-emphasis filters 332A-N) rather than adjusting the input signal directly.

In the example, each de-emphasis filter of the one or more de-emphasis filters 334A-N receives a signal, for example a mixed signal of one or mixed signals output from the mixer 306, reconstructs a signal from the mixed signal, and outputs a reconstructed signal to a speaker of the one or more speakers 308A-M. Each de-emphasis filter can filter a signal, for example, by reducing high frequency energy from the signal. In some embodiments, the de-emphasis filter may turn all abrupt changes in amplitude of the input signal into changes in slopes of the waveform.

Instantaneously changing the values of the control signals can cause a change in the amplitude of the signal's waveform which may introduce predominately high-frequency noise. The pre-emphasis filter reduces the amplitude of the at least one input signal. The de-emphasis filter turns abrupt changes in amplitude of the signal into changes in slopes of the waveform with reduced high-frequency noise.

Figure 3B:
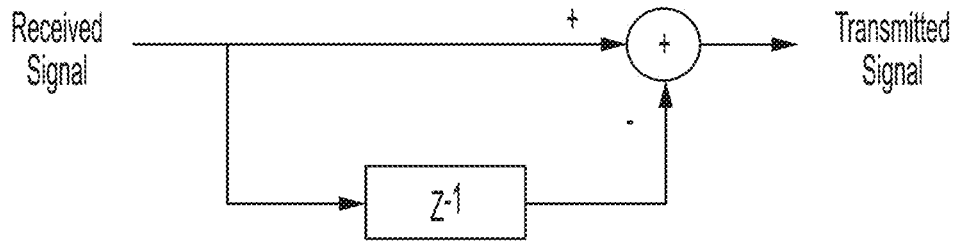
FIG. 3B illustrates an example pre-emphasis filter, according to some embodiments of the disclosure.

FIG. 3B illustrates an example pre-emphasis filter, according to some embodiments. The pre-emphasis filter receives a received signal, filters the received signal, and outputs a transmitted signal. The transmitted signal is a filtered version of the received signal. The pre-emphasis filter may decrease or attenuate amplitude of low frequency content of the received signal while maintaining or amplifying amplitude of high frequency content of the received signal. In some embodiments, the pre-emphasis filter brings the amplitude of the received signal much closer to zero. The pre-emphasis filter may help attenuate any DC offset that may be present in the received signal. In some embodiments, the pre-emphasis filter may include a high pass filter, for example, a first order high pass filter. In some embodiments, the pre-emphasis filter may include a first derivative filter. The first derivative filter may have an approximately six decibel per octave roll-off with decreasing frequencies (e.g., from Nyquist to DC). Consequently, at low frequencies, the received signal may be greatly attenuated relative to an unfiltered version of the received signal.

Figure 3C:
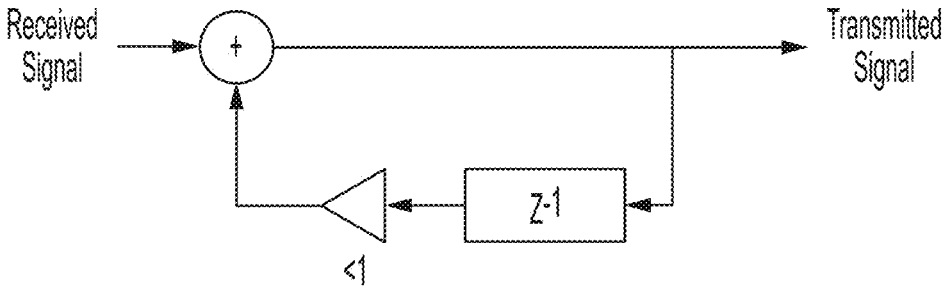
FIG. 3C illustrates an example de-emphasis filter, according to some embodiments of the disclosure.

FIG. 3C illustrates an example de-emphasis filter, according to some embodiments. The de-emphasis filter receives a received signal, filters the received signal, and outputs a transmitted signal. Note the received signal and the transmitted signal of FIG. 3C are not necessarily the same as the received signal and the transmitted signal of FIG. 3B. The transmitted signal is a filtered version of the received signal. The de-emphasis filter may decrease or attenuate amplitude of high frequency content of the received signal while maintaining or amplifying amplitude of low frequency content of the received signal. In some embodiments, the de-emphasis filter may include a low pass filter. In some embodiments, the de-emphasis filter may include an integrator filter, for example, a leaky integrator. The leaky integrator may have an approximately six decibel per octave boost with decreasing frequencies. Consequently, at low frequencies, the received signal may be greatly amplified relative to an unfiltered version of the received signal. In some embodiments, the de-emphasis filter may include a DC blocking filter.

As illustrated in FIG. 3A, the de-emphasis filters 334A-M may be between the mixer 306 and the one or more speakers 308A-M. In this embodiment, the number of de-emphasis filters 334A-M may be the same as the number of outputs of the mixer 306 which may be the same as the number of the one or more speakers 308A-M.

Figure 4:
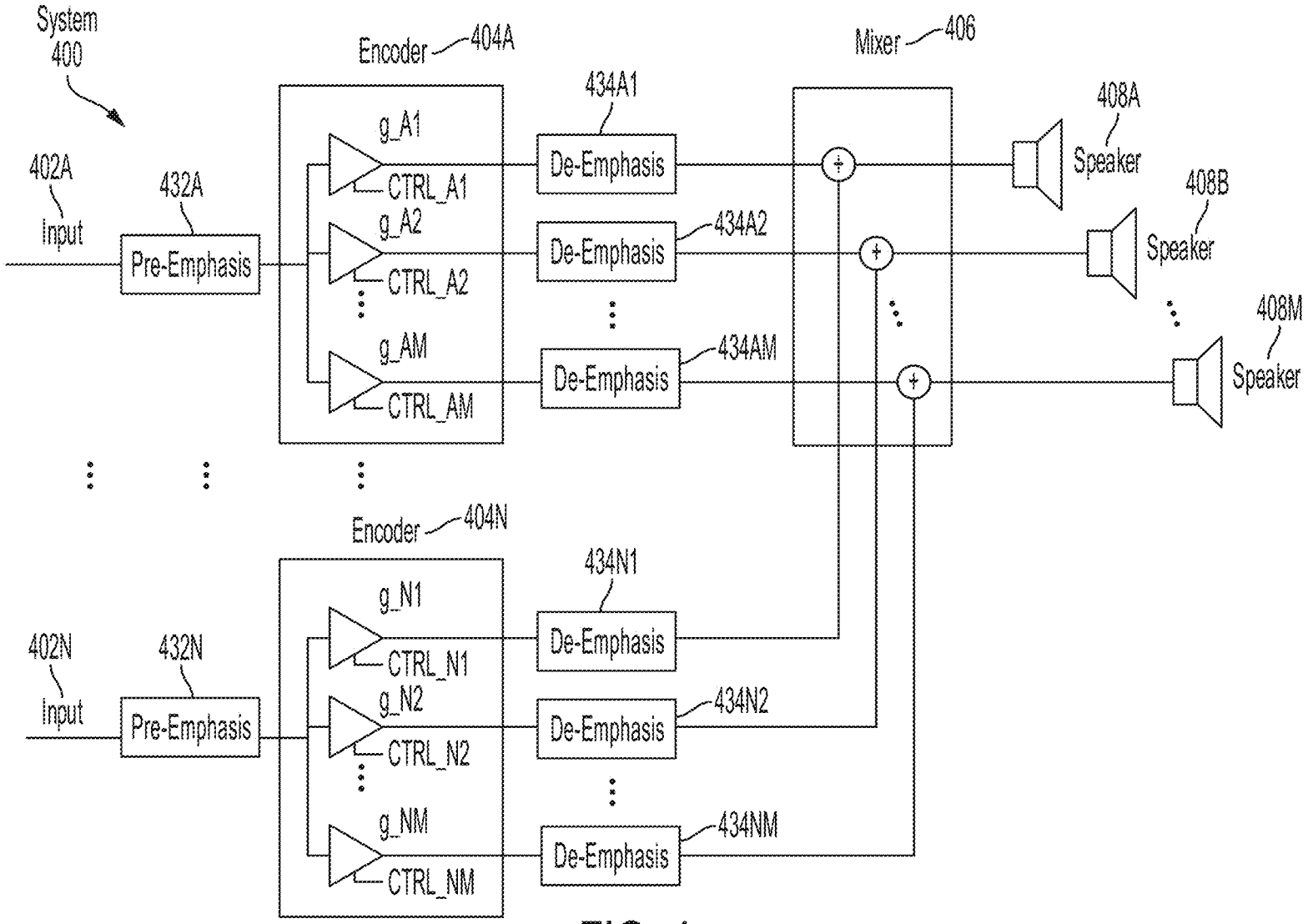
FIGS. 4-8 illustrate example audio spatialization systems including pre-emphasis and de-emphasis filters, according to some embodiments of the disclosure.

FIG. 4 illustrates a spatialization system 400 (hereinafter referred to as "system 400"), according to some embodiments. The system 400 creates a soundscape (sound environment) by spatializing input sounds/signals. The system 400 illustrated in FIG. 4 is similar to the system 300 illustrated in FIG. 3A but may differ in some respects. In the system 400, one or more de-emphasis filters 434A1-NM may be between one or more encoders 404A-N and a mixer 406. In this embodiment, the number of de-emphasis filters 434A1-NM may be the same as the number of outputs from the one or more encoders 404A-N.

Figure 5:
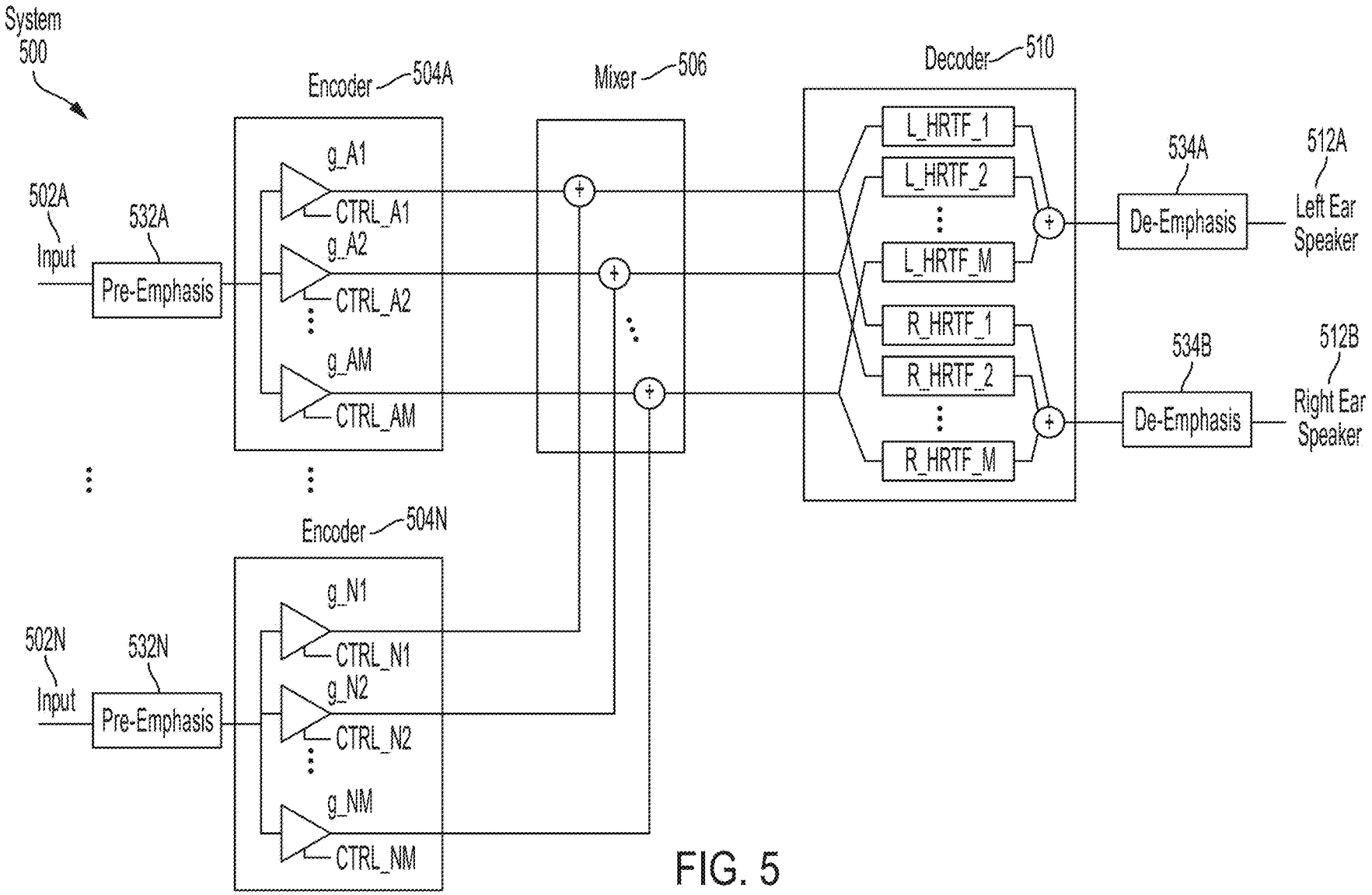

FIG. 5 illustrates a spatialization system 500 (hereinafter referred to as "system 500"), according to some embodiments. The system 500 creates a soundscape (sound environment) by spatializing input sounds/signals. The system 500 illustrated in FIG. 5 is similar to the system 100B illustrated in FIG. 1B but may differ in some respects. In addition to one or more encoders 504A-N, a mixer 506, a decoder 510, a left ear speaker 512A, and a right ear speaker 512B, the system 500 includes one or more pre-emphasis filters 532A-N, a left de-emphasis filters 534A, and a right de-emphasis filter 534B. The addition of the one or more pre-emphasis filters 532A-N and the left and the right de-emphasis filters 534A-B can enable the one or more encoders 504A-N to change values of the control signals CTRL_A1-NM instantaneously, without resulting in sonic artifacts at the left and right speakers 512A-B. In some embodiments, the one or more pre-emphasis filters 532A-N and the left and right de-emphasis filters 534A-B reduce noise. The one or more pre-emphasis filters 532A-N may be the same as the pre-emphasis filter illustrated in FIG. 3B and described above. The left and the right de-emphasis filters 534A-B may be the same as the de-emphasis filter illustrated in FIG. 3C and described above.

Figure 6:
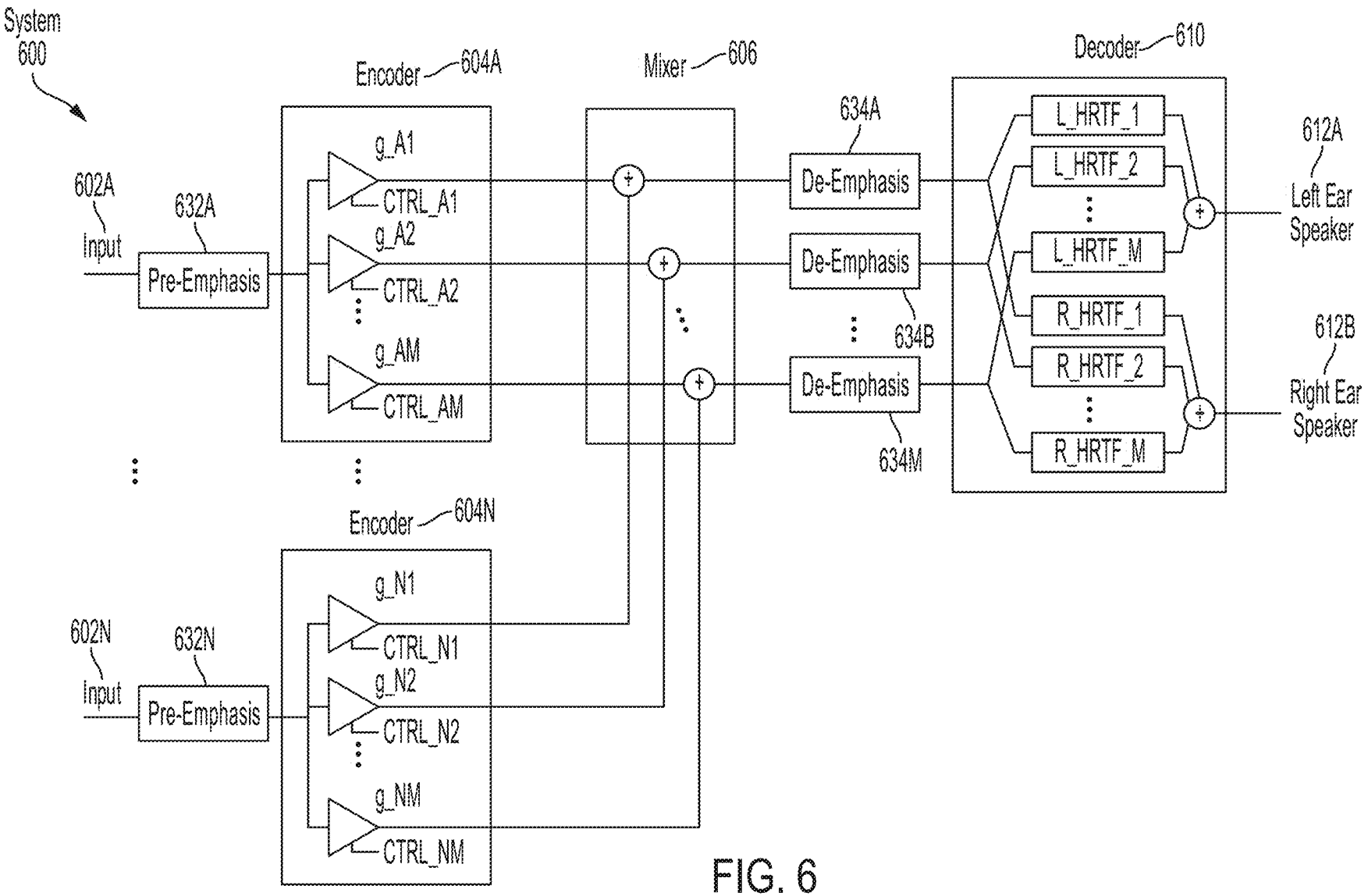

FIG. 6 illustrates a spatialization system 600 (hereinafter referred to as "system 600"), according to some embodiments. The system 600 creates a soundscape (sound environment) by spatializing input sounds/signals. The system 600 illustrated in FIG. 6 is similar to the system 500 illustrated in FIG. 5 but may differ in some respects. In the system 600, one or more de-emphasis filters 634A-M may be between a mixer 606 and a decoder 610. In this embodiment, the number of de-emphasis filters 634A-M may be the same as the number of outputs of the mixer 606 which may be the same as the number of left and right HRTF filter pairs in the decoder 610.

Figure 7:
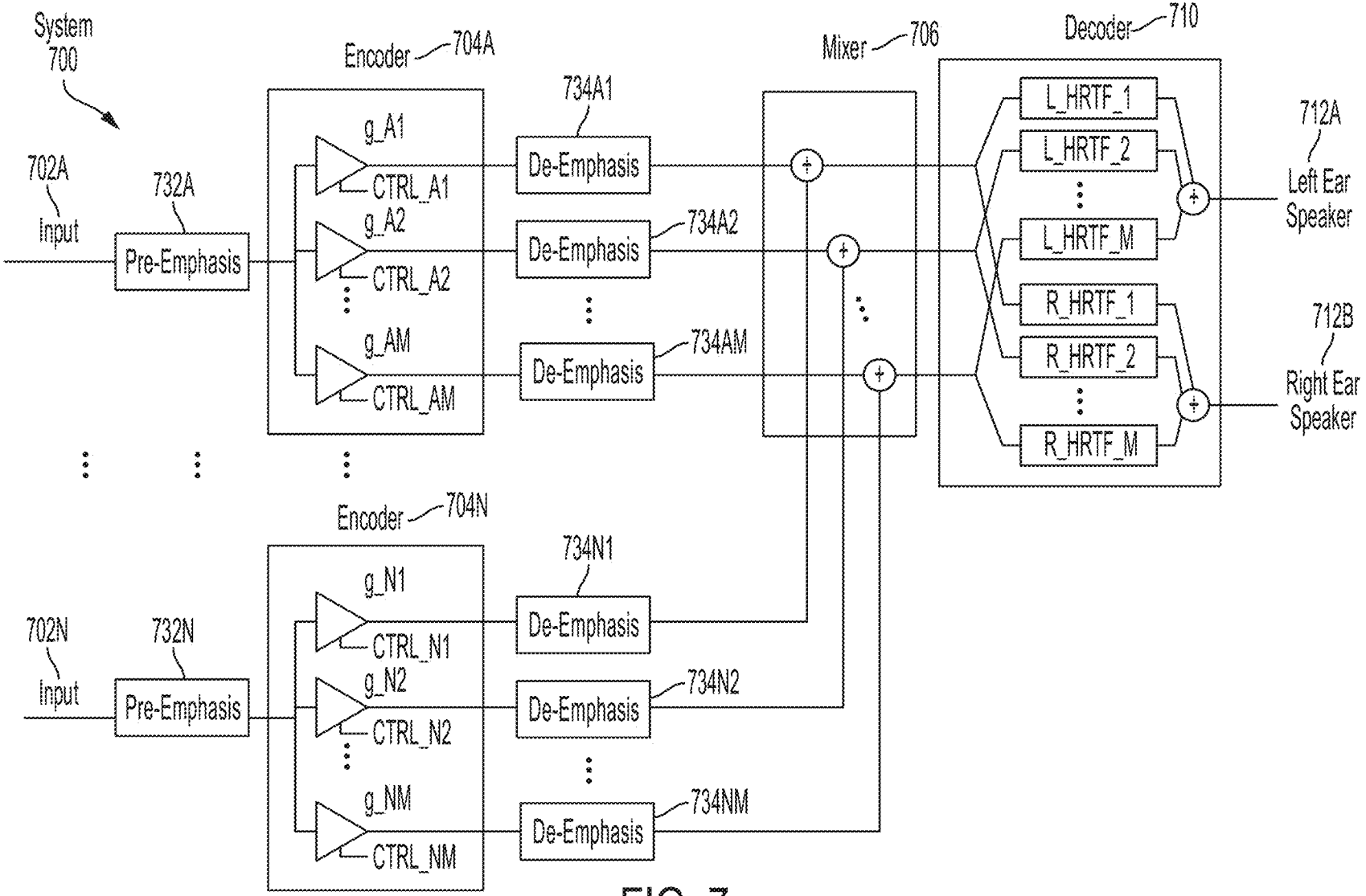

FIG. 7 illustrates a spatialization system 700 (hereinafter referred to as "system 700"), according to some embodiments. The system 700 creates a soundscape (sound environment) by spatializing input sounds/signals. The system 700 illustrated in FIG. 7 is similar to the system 500 illustrated in FIG. 5 but may differ in some respects. In the system 700, one or more de-emphasis filters 734A1-NM may be between one or more encoders 704A-N and a mixer 706. In this embodiment, the number of de-emphasis filters 734A1-NM may be the same as the number of outputs from the one or more encoders 704A-N.

Figure 8:
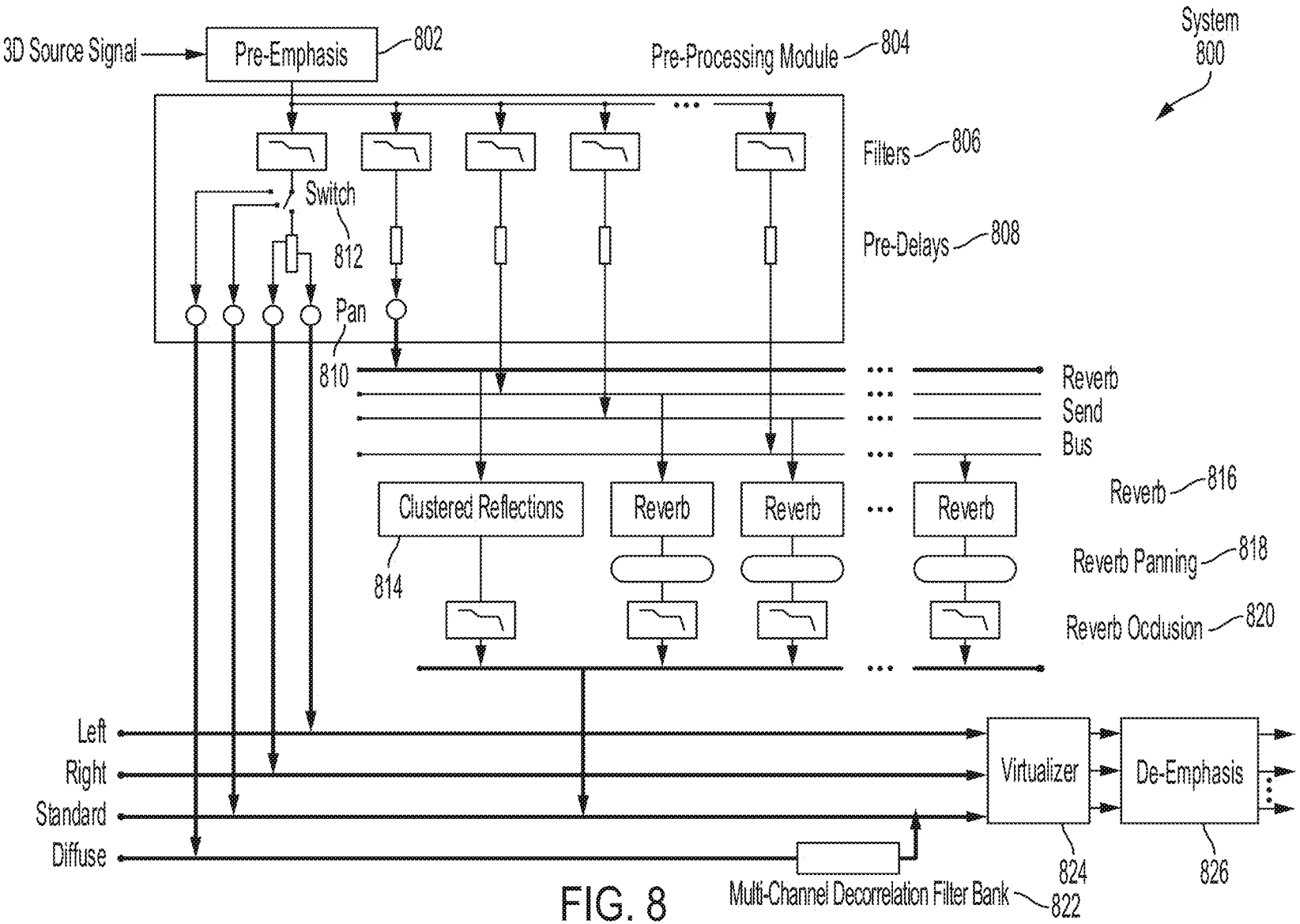

FIG. 8 illustrates a spatialization system 800 (hereafter referred to as "system 800"), according to some embodiments. The system 800 includes a pre-emphasis filter 802, a pre-processing module 804, a clustered reflections module 814, reverberations modules 816, reverberation panning modules 818, reverberation occlusion modules 820, a multichannel decorrelation filter bank 822, a virtualizer 824, and a de-emphasis filter 826.

In some embodiments, the filters 806, clustered reflections 814, reverberation module 816, reverberation panning module 818, and/or reverberation occlusion module 820 may be adjusted based on one or values of one or more control signals. In embodiments without the pre-emphasis filter 802 and the de-emphasis filter 826, instantaneously and/or repeatedly changing the values of the control signals may result in sonic artifacts. The pre-emphasis filter 802 and the de-emphasis filter 826 may reduce the severity of the sonic artifacts, such as described above.

In the example shown, the pre-emphasis filter 802 receives a 3D source signal, filters the 3D source signal, and outputs a filtered signal to the pre-processing module 804. The 3D source signal may be analogous to the input signals described above, for example, with respect to FIGS. 1A-1B, 3A, and 4-7. The pre-emphasis filter 802 may be analogous to the pre-emphasis filters described above, for example, with respect to FIGS. 3A-3B, and 4-7.

The pre-processing module 804 includes one or more filters 806, one or more pre-delay modules 808, one or more panning modules 810, and a switch 812.

The filtered signal received from the pre-emphasis filter 802 is input to the one or more filters 806. The one or more filters 806 may be, for example, distance filters, air absorption filters, source directivity filters, occlusion filters, obstruction filters, and the like. A first filter of the one or more filters 806 outputs a signal to the switch 812, and the remaining filters of the one or more filters 806 output respective signals to pre-delay modules 808.

The switch 812 receives a signal output from the first filter and directs the signal to a first panning module, to a second panning module, or an interaural time difference (ITD) delay module. The ITD delay module outputs a first delayed signal to a third panning module and a second delayed signal to a fourth panning module.

The one or more pre-delay modules 808 each receive a respective signal, delay the received signal, and output a delayed version of the received signal. A first pre-delay module outputs first delayed signal to a fifth panning module. The remaining delay modules output delayed signals to various reverberation send buses.

The one or more panning modules 810 each pan a respective input signal to a bus. The first panning module pans the signal into a diffuse bus, the second panning module pans the signal into a standard bus, the third panning module pans the signal into a left bus, the fourth panning module pans the signal into a right bus, and the fifth panning module pans the signal into a clustered reflections bus.

The clustered reflections bus outputs a signal to the clustered reflections module 814. The clustered reflections module 814 generates a cluster of reflections and outputs the cluster of reflections to a clustered reflections occlusion module.

The various reverberation send buses output signals to various reverberation modules 816. The reverberation modules 816 generate reverberations and output the reverberations to various reverberation panning modules 818. The reverberation panning modules 818 pan the reverberations to various reverberation occlusion modules 820. The reverberation occlusion modules 820 model occlusions and other properties similar to the filters 806 and output occluded panned reverberations to the standard bus.

The multi-channel decorrelation filter bank 822 receives the diffuse bus and applies one or more decorrelation filters; for example, the filter bank 822 spreads signals to create sounds of non-point sources and outputs the diffused signals to the standard bus.

The virtualizer 824 receives the left bus, the right bus, and the standard bus and outputs signals to the de-emphasis filter 826. The virtualizer 824 may be analogous to decoders described above, for example, with respect to FIGS. 1B and 5-7. The de-emphasis filter 826 may be analogous to the de-emphasis filters described above, for example, with respect to FIGS. 3A, 3C, and 4-7.

Various exemplary embodiments of the disclosure are described herein. Reference is made to these examples in a non-limiting sense. They are provided to illustrate more broadly applicable aspects of the disclosure. Various changes may be made to the disclosure described and equivalents may be substituted without departing from the true spirit and scope of the disclosure. In addition, many modifications may be made to adapt a particular situation, material, composition of matter, process, process act(s) or step(s) to the objective(s), spirit or scope of the present disclosure. Further, as will be appreciated by those with skill in the art that each of the individual variations described and illustrated herein has discrete components and features which may be readily separated from or combined with the features of any of the other several embodiments without departing from the scope or spirit of the present disclosure. All such modifications are intended to be within the scope of claims associated with this disclosure.

The disclosure includes methods that may be performed using the subject devices. The methods may include the act of providing such a suitable device. Such provision may be performed by the end user. In other words, the "providing" act merely requires the end user obtain, access, approach, position, set-up, activate, power-up or otherwise act to provide the requisite device in the subject method. Methods recited herein may be carried out in any order of the recited events which is logically possible, as well as in the recited order of events.

Exemplary aspects of the disclosure, together with details regarding material selection and manufacture have been set forth above. As for other details of the present disclosure, these may be appreciated in connection with the above-referenced patents and publications as well as generally known or appreciated by those with skill in the art. The same may hold true with respect to method-based aspects of the disclosure in terms of additional acts as commonly or logically employed.

In addition, though the disclosure has been described in reference to several examples optionally incorporating various features, the disclosure is not to be limited to that which is described or indicated as contemplated with respect to each variation of the disclosure. Various changes may be made to the disclosure described and equivalents (whether recited herein or not included for the sake of some brevity) may be substituted without departing from the true spirit and scope of the disclosure. In addition, where a range of values is provided, it is understood that every intervening value, between the upper and lower limit of that range and any other stated or intervening value in that stated range, is encompassed within the disclosure.

Also, it is contemplated that any optional feature of the variations described may be set forth and claimed independently, or in combination with any one or more of the features described herein. Reference to a singular item, includes the possibility that there are plural of the same items present. More specifically, as used herein and in claims associated hereto, the singular forms "a," "an," "said," and "the" include plural referents unless the specifically stated otherwise. In other words, use of the articles allow for "at least one" of the subject item in the description above as well as claims associated with this disclosure. It is further noted that such claims may be drafted to exclude any optional element. As such, this statement is intended to serve as antecedent basis for use of such exclusive terminology as "solely," "only" and the like in connection with the recitation of claim elements, or use of a "negative" limitation.

Without the use of such exclusive terminology, the term "comprising" in claims associated with this disclosure shall allow for the inclusion of any additional element—irrespective of whether a given number of elements are enumerated in such claims, or the addition of a feature could be regarded as transforming the nature of an element set forth in such claims. Except as specifically defined herein, all technical and scientific terms used herein are to be given as broad a commonly understood meaning as possible while maintaining claim validity.

The breadth of the present disclosure is not to be limited to the examples provided and/or the subject specification, but rather only by the scope of claim language associated with this disclosure.

What is claimed is:

1. A method of presenting an audio signal to a user of a wearable head device, the method comprising:

receiving a first input audio signal, the first input audio signal associated with a virtual environment presented on a display of the wearable head device;

processing the first input audio signal to generate a first output audio signal, the first output audio signal associated with the virtual environment, wherein processing the first input audio signal comprises:

applying a pre-emphasis filter to the first input audio signal;

adjusting a gain of the first input audio signal; and applying a de-emphasis filter to the first input audio signal; and presenting the first output audio signal via one or more speakers associated with the wearable head device, wherein:

applying the pre-emphasis filter to the first input audio signal comprises attenuating a low frequency component of the first input audio signal, and applying the de-emphasis filter to the first input audio signal comprises attenuating a high frequency component of the first input audio signal.

2. The method of claim 1, wherein the pre-emphasis filter comprises a first derivative filter.

3. The method of claim 2, wherein the first derivative filter has a per-octave roll off of approximately six decibels.

4. The method of claim 1, wherein applying the de-emphasis filter to the first input audio signal further comprises maintaining or increasing an amplitude of a low frequency component of the first input audio signal.

5. The method of claim 1, wherein the de-emphasis filter comprises an integrator filter.

6. The method of claim 1, wherein the de-emphasis filter comprises a leaky integrator with a per-octave boost of approximately six decibels.

7. The method of claim 1, wherein the de-emphasis filter comprises a DC blocking filter.

8. The method of claim 1, further comprising receiving a second input audio signal, wherein:

processing the first input audio signal to generate the first output audio signal further comprises mixing, via a mixer, the first input audio signal with the second input audio signal.

9. The method of claim 1, wherein presenting the first output audio signal via one or more speakers of the wearable head device comprises:

applying a first head-related transfer function (HRTF) to the first output audio signal;

presenting the output of the first HRTF to a left speaker of the one or more speakers of the wearable head device;

applying a second HRTF to the first output audio signal; and presenting the output of the second HRTF to a right speaker of the one or more speakers of the wearable head device.

10. The method of claim 1, wherein processing the first input audio signal to generate the first output audio signal further comprises:

applying an output of the pre-emphasis filter to one or more filters;

panning a first output of the one or more filters to generate a first panned signal, a second panned signal, a third panned signal, and a fourth panned signal;

applying the first panned signal to a left bus;

applying the second panned signal to a right bus;

applying the third panned signal to a standard bus;

applying the fourth panned signal to a diffuse bus; and applying the left bus, the right bus, the standard bus, and the diffuse bus as input to a virtualizer, wherein applying the de-emphasis filter to the first audio signal comprises applying the de-emphasis filter to the output of the virtualizer.

11. The method of claim 10, wherein processing the first input audio signal to generate the first output audio signal further comprises applying a pre-delay to the first panned signal and the second panned signal.

12. The method of claim 10, wherein processing the first input audio signal to generate the first output audio signal further comprises applying a decorrelation filter to the diffuse bus.

13. The method of claim 10, wherein processing the first input audio signal to generate the first output audio signal further comprises applying a second output of the one or more filters as input to a clustered reflections module, and applying the output of the clustered reflections module to the standard bus.

14. The method of claim 10, wherein processing the first input audio signal to generate the first output audio signal further comprises applying a second output of the one or more filters as input to a reverb module, and applying the output of the reverb module to the standard bus.

15. The method of claim 10, wherein the one or more filters comprises a distance filter.

16. The method of claim 10, wherein the one or more filters comprises an air absorption filter.

17. The method of claim 10, wherein the one or more filters comprises a source directivity filter.

18. The method of claim 10, wherein the one or more filters comprises an occlusion filter.

19. The method of claim 10, wherein the one or more filters comprises an obstruction filter.

20. A system comprising:

a wearable head device;

one or more speakers;

one or more processors configured to execute a method comprising:

receiving a first input audio signal, the first input audio signal associated with a virtual environment presented on a display of the wearable head device;

processing the first input audio signal to generate a first output audio signal, the first output audio signal associated with the virtual environment, wherein processing the first input audio signal comprises:

applying a pre-emphasis filter to the first input audio signal;

adjusting a gain of the first input audio signal; and applying a de-emphasis filter to the first input audio signal; and presenting the first output audio signal via the one or more speakers, wherein:

applying the pre-emphasis filter to the first input audio signal comprises attenuating a low frequency component of the first input audio signal, and applying the de-emphasis filter to the first input audio signal comprises attenuating a high frequency component of the first input audio signal.

21. The system of claim 20, wherein the pre-emphasis filter comprises a first derivative filter.

22. The system of claim 21, wherein the first derivative filter has a per-octave roll off of approximately six decibels.

23. The system of claim 20, wherein applying the de-emphasis filter to the first input audio signal further comprises maintaining or increasing an amplitude of a low frequency component of the first input audio signal.

24. The system of claim 20, wherein the de-emphasis filter comprises an integrator filter.

25. The system of claim 20, wherein the de-emphasis filter comprises a leaky integrator with a per-octave boost of approximately six decibels.

26. The system of claim 20, wherein the de-emphasis filter comprises a DC blocking filter.

27. The system of claim 20, the method further comprising receiving a second input audio signal, wherein:

processing the first input audio signal to generate the first output audio signal further comprises mixing, via a mixer, the first input audio signal with the second input audio signal.

28. The system of claim 20, wherein presenting the first output audio signal via one or more speakers of the wearable head device comprises:

applying a first head-related transfer function (HRTF) to the first output audio signal;

presenting the output of the first HRTF to a left speaker of the one or more speakers of the wearable head device;

applying a second HRTF to the first output audio signal; and presenting the output of the second HRTF to a right speaker of the one or more speakers of the wearable head device.

29. The system of claim 20, wherein processing the first input audio signal to generate the first output audio signal further comprises:

applying an output of the pre-emphasis filter to one or more filters;

panning a first output of the one or more filters to generate a first panned signal, a second panned signal, a third panned signal, and a fourth panned signal;

applying the first panned signal to a left bus;

applying the second panned signal to a right bus;

applying the third panned signal to a standard bus;

applying the fourth panned signal to a diffuse bus; and applying the left bus, the right bus, the standard bus, and the diffuse bus as input to a virtualizer, wherein applying the de-emphasis filter to the first audio signal comprises applying the de-emphasis filter to the output of the virtualizer.

30. The system of claim 29, wherein processing the first input audio signal to generate the first output audio signal further comprises applying a pre-delay to the first panned signal and the second panned signal.

31. The system of claim 29, wherein processing the first input audio signal to generate the first output audio signal further comprises applying a decorrelation filter to the diffuse bus.

32. The system of claim 29, wherein processing the first input audio signal to generate the first output audio signal further comprises applying a second output of the one or more filters as input to a clustered reflections module, and applying the output of the clustered reflections module to the standard bus.

33. The system of claim 29, wherein processing the first input audio signal to generate the first output audio signal further comprises applying a second output of the one or more filters as input to a reverb module, and applying the output of the reverb module to the standard bus.

34. The system of claim 29, wherein the one or more filters comprises a distance filter.

35. The system of claim 29, wherein the one or more filters comprises an air absorption filter.

36. The system of claim 29, wherein the one or more filters comprises a source directivity filter.

37. The system of claim 29, wherein the one or more filters comprises an occlusion filter.

38. The system of claim 29, wherein the one or more filters comprises an obstruction filter.

39. A non-transitory computer-readable medium storing instructions, which when executed by one or more processors cause the one or more processors to perform a method of presenting an audio signal to a user of a wearable head device, the method comprising:

receiving a first input audio signal, the first input audio signal associated with a virtual environment presented on a display of the wearable head device;

processing the first input audio signal to generate a first output audio signal, the first output audio signal associated with the virtual environment, wherein processing the first input audio signal comprises:

applying a pre-emphasis filter to the first input audio signal;

adjusting a gain of the first input audio signal; and applying a de-emphasis filter to the first input audio signal; and presenting the first output audio signal via one or more speakers associated with the wearable head device, wherein:

applying the pre-emphasis filter to the first input audio signal comprises attenuating a low frequency component of the first input audio signal, and applying the de-emphasis filter to the first input audio signal comprises attenuating a high frequency component of the first input audio signal.

40. The non-transitory computer-readable medium of claim 39, wherein the pre-emphasis filter comprises a first derivative filter.

41. The non-transitory computer-readable medium of claim 40, wherein the first derivative filter has a per-octave roll off of approximately six decibels.

42. The non-transitory computer-readable medium of claim 39, wherein applying the de-emphasis filter to the first input audio signal further comprises maintaining or increasing an amplitude of a low frequency component of the first input audio signal.

43. The non-transitory computer-readable medium of claim 39, wherein the de-emphasis filter comprises an integrator filter.

44. The non-transitory computer-readable medium of claim 39, wherein the de-emphasis filter comprises a leaky integrator with a per-octave boost of approximately six decibels.

45. The non-transitory computer-readable medium of claim 39, wherein the de-emphasis filter comprises a DC blocking filter.

46. The non-transitory computer-readable medium of claim 39, the method further comprising receiving a second input audio signal, wherein:

processing the first input audio signal to generate the first output audio signal further comprises mixing, via a mixer, the first input audio signal with the second input audio signal.

47. The non-transitory computer-readable medium of claim 39, wherein presenting the first output audio signal via one or more speakers of the wearable head device comprises:

applying a first head-related transfer function (HRTF) to the first output audio signal;

presenting the output of the first HRTF to a left speaker of the one or more speakers of the wearable head device;

applying a second HRTF to the first output audio signal; and presenting the output of the second HRTF to a right speaker of the one or more speakers of the wearable head device.

48. The non-transitory computer-readable medium of claim 39, wherein processing the first input audio signal to generate the first output audio signal further comprises:

applying an output of the pre-emphasis filter to one or more filters;

panning a first output of the one or more filters to generate a first panned signal, a second panned signal, a third panned signal, and a fourth panned signal;

applying the first panned signal to a left bus;

applying the second panned signal to a right bus;

applying the third panned signal to a standard bus;

applying the fourth panned signal to a diffuse bus; and applying the left bus, the right bus, the standard bus, and the diffuse bus as input to a virtualizer, wherein applying the de-emphasis filter to the first audio signal comprises applying the de-emphasis filter to the output of the virtualizer.

49. The non-transitory computer-readable medium of claim 48, wherein processing the first input audio signal to generate the first output audio signal further comprises applying a pre-delay to the first panned signal and the second panned signal.

50. The non-transitory computer-readable medium of claim 48, wherein processing the first input audio signal to generate the first output audio signal further comprises applying a decorrelation filter to the diffuse bus.

51. The non-transitory computer-readable medium of claim 48, wherein processing the first input audio signal to generate the first output audio signal further comprises applying a second output of the one or more filters as input to a clustered reflections module, and applying the output of the clustered reflections module to the standard bus.

52. The non-transitory computer-readable medium of claim 48, wherein processing the first input audio signal to generate the first output audio signal further comprises applying a second output of the one or more filters as input to a reverb module, and applying the output of the reverb module to the standard bus.

53. The non-transitory computer-readable medium of claim 48, wherein the one or more filters comprises a distance filter.

54. The non-transitory computer-readable medium of claim 48, wherein the one or more filters comprises an air absorption filter.

55. The non-transitory computer-readable medium of claim 48, wherein the one or more filters comprises a source directivity filter.

56. The non-transitory computer-readable medium of claim 48, wherein the one or more filters comprises an occlusion filter.

57. The non-transitory computer-readable medium of claim 48, wherein the one or more filters comprises an obstruction filter.

* * * * *